US007163753B2

(12) United States Patent
Ota et al.

(10) Patent No.: US 7,163,753 B2
(45) Date of Patent: Jan. 16, 2007

(54) ARC-RESISTANT TERMINAL, ARC-RESISTANT TERMINAL COUPLE AND CONNECTOR OR THE LIKE FOR AUTOMOBILE

(75) Inventors: Kouji Ota, Nagoya (JP); Hiroki Hirai, Nagoya (JP); Yoshitugu Tsuji, Nagoya (JP); Masahiro Shibata, Osaka (JP); Atsushi Kimura, Osaka (JP); Toshiaki Sakai, Osaka (JP); Satoshi Takano, Osaka (JP); Masahiko Kanda, Osaka (JP); Narito Yagi, Osaka (JP)

(73) Assignees: Sumitomo Wiring Systems, Ltd., Mie (JP); Sumitomo Electric Industries, Ltd., Osaka (JP); Autonetworks Technologies, Ltd., Aichi (JP)

( * ) Notice: Subject to any disclaimer, the term of this patent is extended or adjusted under 35 U.S.C. 154(b) by 83 days.

(21) Appl. No.: 10/413,388

(22) Filed: Apr. 15, 2003

(65) Prior Publication Data

US 2003/0194893 A1 Oct. 16, 2003

(30) Foreign Application Priority Data

| | | |
|---|---|---|
| Apr. 15, 2002 | (JP) | 2002-112588 |
| Jul. 12, 2002 | (JP) | 2002-204761 |
| Jul. 17, 2002 | (JP) | 2002-208903 |
| Jul. 19, 2002 | (JP) | 2002-242719 |
| Aug. 21, 2002 | (JP) | 2002-241116 |
| Oct. 2, 2002 | (JP) | 2002-290414 |
| Nov. 5, 2002 | (JP) | 2002-321414 |

(51) Int. Cl.
*H01R 13/03* (2006.01)

(52) U.S. Cl. ..... 428/647; 428/674; 428/675; 428/672; 428/673; 428/929; 439/886; 439/887

(58) Field of Classification Search ..... 428/929, 428/674, 675, 647, 672, 673; 420/496, 469, 420/499; 439/887, 886, 181, 520; 361/115; 200/266, 268

See application file for complete search history.

(56) References Cited

U.S. PATENT DOCUMENTS 3,528,803 A * 9/1970 Hiroshi et al. ..... 75/651

(Continued)

FOREIGN PATENT DOCUMENTS

DE 69814657 3/2004

(Continued)

OTHER PUBLICATIONS

English Language Abstract of JP Appln. No. 2001-266985.

(Continued)

*Primary Examiner*—John J. Zimmerman
(74) *Attorney, Agent, or Firm*—Greenblum & Bernstein, P.L.C.

(57) ABSTRACT

An arc-resistant terminal, couple, and connecter are provided. In an embodiment, a metal-based electrical contact portion thereof includes at least one of Cu, Ni or Sn, and not more than 0.06 mass % P, wherein the arc-resistant terminal capable of suppressing arc discharge wherein a voltage between the arc-resistant terminal and a second terminal immediately after separation thereof is DC36V to 60V and a current between terminals during contact is 6A to 30A. In another embodiment, the an electrical contact portion comprising at least 80 mass % of metal having a boiling point of not less than 1000 degrees centigrade. According to the present invention, since the electrical contact portion or the final contact portion of the terminal includes a specific metal-based material, even when the voltage applied between the terminals is increased and an arc discharge is liable to be generated, the arc discharge can be suppressed. The arc-resistant terminal of the present invention can be suitably used in a connector for an automobile, a joint box provided with the connector portion and the like. This abstract is neither intended to define the invention disclosed in this specification nor intended to limit the scope of the invention in any way.

60 Claims, 14 Drawing Sheets

U.S. PATENT DOCUMENTS

| | | | | | |
|---|---|---|---|---|---|
| 3,777,302 | A | | 12/1973 | Travis | |
| 3,777,303 | A | * | 12/1973 | McDonough | 439/857 |
| 4,290,806 | A | * | 9/1981 | Inoue et al. | 420/496 |
| 4,634,824 | A | * | 1/1987 | Takano | 200/266 |
| 4,732,732 | A | * | 3/1988 | Miyafuji et al. | 420/476 |
| 4,822,562 | A | * | 4/1989 | Miyafuji et al. | 420/472 |
| 4,990,820 | A | * | 2/1991 | Suster et al. | 313/49 |
| 5,024,814 | A | * | 6/1991 | Futatasuka et al. | 420/473 |
| 5,387,293 | A | * | 2/1995 | Endo et al. | 148/412 |
| 6,093,265 | A | * | 7/2000 | Brenneman | 148/432 |
| 6,344,171 | B1 | * | 2/2002 | Nomura | 420/473 |
| 2001/0024895 | A1 | | 9/2001 | Sakiyama et al. | |
| 2002/0012603 | A1 | * | 1/2002 | Miwa | 420/485 |
| 2003/0176093 | A1 | * | 9/2003 | Ota et al. | 439/181 |
| 2004/0137772 | A1 | * | 7/2004 | Ota et al. | 439/181 |

FOREIGN PATENT DOCUMENTS

| | | | |
|---|---|---|---|
| GB | 2111306 | | 6/1983 |
| JP | 61-186496 | * | 8/1986 |
| JP | 02-145737 | * | 6/1990 |
| JP | 09-143595 | * | 6/1997 |
| JP | 2001266985 | | 9/2001 |
| JP | 2001266986 | | 9/2001 |
| JP | 2001-335864 | * | 12/2001 |
| JP | 2002-294362 | * | 10/2002 |
| JP | 2002294362 | | 10/2002 |
| WO | 9913117 | | 3/1999 |

OTHER PUBLICATIONS

English Language Abstract of JP Appln. No. 2001-318545.
English Language Abstract of JP Appln. No. 2002-294362.

* cited by examiner

ARC-RESISTANT TERMINAL, ARC-RESISTANT TERMINAL COUPLE AND CONNECTOR OR THE LIKE FOR AUTOMOBILE

FIELD OF THE INVENTION

The present invention relates to a terminal and a terminal couple for an electrical connection in a high voltage application such as an automobile, and a connector or the like for an automobile (for example, connector, joint box and the like) which includes the above-mentioned terminal.

DESCRIPTION OF THE RELATED ART

In some cases, a connector served for an automobile or the like is removed at a frequency of one time for several months to several years for maintenance and checking of the automobile. However, there exists a fear that an arc discharge is generated between terminals of the connector at a moment that terminals of these connectors are separated. Particularly, recently, a battery voltage is no more restricted to a conventional level of approximately DC12V and a demand for higher voltage such as DC36V is in progress and hence, there is a fear that a considerably large arc will be generated. In such a case, there may be a case that the terminal is damaged due to this phenomenon. For example, a male terminal usually has a rod-like or a plate-like shape and a distal end portion thereof has a somewhat sharpened shape to facilitate the insertion of the male terminal into a female terminal. However, due to the repetition of the above-mentioned engagement and removal of the terminal and the generation of arc discharge which follows the engagement and removal of the terminal, the once-sharpened distal end portion is melted, is slightly moved toward a proximal portion, and is solidified by cooling and hence, the distal end portion is rounded and swelled. That is, there is a possibility that the terminal is remarkably deformed. Accordingly, there is a fear that this gives rise to a contact failure and, in a worst case, the male terminal cannot be inserted into the female terminal (discussed for example, on page 2 of Japanese Patent Publication No. JP2001-266985A, and on page 2 of Japanese Patent Publication No. JP2001-266986A).

Conventionally, brass which is a Cu—Zn based alloy has been used as a base material for terminal and this base material contains approximately 35 mass % of Zn (boiling point: 907 degrees centigrade). Further, there is a case that a terminal for lines for transmitting and receiving electrical signals uses pure copper as a base material thereof although the terminal is not served as a connector.

SUMMARY OF THE INVENTION

The present invention provides a terminal, a terminal couple and a connector or the like provided with the terminal for an automobile which can effectively suppress the generation of arc discharge even when a voltage applied between terminals is increased.

According to the present invention, since the base material of the electrical contact portion or the final contact portion of the terminal is formed of a specific metal-based material, even when the voltage applied between the terminals is increased and an arc discharge is liable to be generated, the arc discharge can be suppressed. Particularly, the arc discharge can be further effectively suppressed with the use of the metal-based material which contains Cu and Sn. The arc-resistant terminal of the present invention can be suitably used in a connector for an automobile, a joint box provided with the connector portion and the like.

With respect to a low-current-use terminal such as a conventional signal-transmission-use terminal or an intermediate-voltage-use terminal such as a DC12V-voltage-use terminal, difference in arc resistance is not found at all between the terminal whose base metal is brass and the terminal whose base metal is pure copper. To the contrary, although when a high current to 6 A to 30 A is supplied at a high voltage of 36V to 60V, the arc discharge is generated when the base metal is formed of brass, while the arc discharge can be suppressed when the base metal is mainly formed of metal such as Cu, Ni, Sn or the like. Besides Cu, Ni, Sn, components which are contained in the base metal largely influence the arc discharge resistance and the arc discharge can be remarkably suppressed also in the application of high voltage by suppressing a content of these components in the base metal to a value not more than a fixed quantity.

Additionally, components having a boiling point of less than 1000, or even 2000 degrees centigrade are liable to easily generate an arc discharge and the arc discharge can be remarkably suppressed also in the high voltage application by suppressing a quantity of such components in the base metal to a value not more than a fixed quantity.

Further, in this specification, voltage means a direct current (DC) voltage. Still further, the voltage between terminals immediately after separation assumes a value equal to that of a battery voltage when the terminal or the connector is applied to an automobile. Then, for example, it is appreciated that the description "DC36V" has a width of approximately ±1V.

The arc-resistant connector terminal according to the present invention is used in an application in which a voltage between terminals immediately after separation (also simply referred to as "voltage between terminals" hereinafter) is DC36V to 60V and a current between terminals at the time of contact (also referred to as "current between terminals" hereinafter) is 6 A to 30 A. Specifically, in the application with such voltage and current ranges, while the conventional connector terminal generates an arc discharge, the arc discharge can be suppressed by the application of the present invention. Among the above-mentioned ranges of voltage between terminals and current between terminals, the more preferable practical ranges are that the voltage between terminals immediately after separation is DC 36 V or DC 42 V, and the current between terminals at the time of contact is 10 A to 30 A. Here, the separation speed of the terminal is not particularly limited. For example, it is possible to surely suppress the arc discharge so long as the separation speed of the terminals falls within a range of approximately 30 to 600 mm/min (particularly approximately 40 to 550 mm/min).

The connector terminal according to the present invention is a terminal which supplies electricity by contacting another terminal and the base material of the electrical contact portion is preferably formed of the metal-based material which will be explained hereinafter. It is also a preferred mode of the present invention that the connector terminal of the present invention is a terminal which supplies electricity upon contacting another terminal, and assuming a portion thereof which is lastly separated from the electrical contact portion of other terminal when the terminal is separated from other terminal as a final contact portion, at least the final contact portion is formed of metal-based materials described hereinafter.

Thus, in certain embodiments, there are provided: An arc-resistant terminal comprising: a metal-based electrical contact portion comprising at least one of Cu, Ni or Sn, and not more than 0.06 mass % P, wherein the arc-resistant terminal is capable of suppressing arc discharge upon terminal separation under conditions wherein a voltage between the arc-resistant terminal and a second terminal immediately after separation thereof is DC36V to 60V and a current between terminals during contact is 6 A to 30 A.

An arc-resistant terminal wherein the electrical contact portion comprises Cu and a positive amount not more than 6 mass % Sn. An arc-resistant terminal, wherein the electrical contact portion comprises Cu, not more than 0.05 mass % P, a positive amount not more than 0.9 mass % Sn, and a positive amount not more than 1 mass % Ni.

An arc-resistant terminal wherein the electrical contact comprises not more than 0.04 mass % P. An arc-resistant terminal, wherein the electrical contact comprises 0 mass % P. An arc-resistant terminal, wherein the electrical contact comprises two of Cu, Ni, or Sn.

An arc-resistant terminal, comprising a positive content of Be of not more than 2 mass %, Cu, and inevitable impurities.

An arc-resistant terminal, comprising: not more than 0.045 mass % P, not more than 0.08 mass % C, not more than 1 mass % Si, not more than 2 mass % Mn, not more than 0.03 mass % S, 8 to 10.5 mass % Ni, 18 to 20 mass % Cr, Fe, and inevitable impurities.

An arc-resistant terminal comprising a metal-based electrical contact comprising at least one of Cu, Ni or Sn, not more than 0.06 mass % P, and a positive amount not more than 0.6 mass % of at least one of Fe, W, Ag, Al, Mo or Au. An arc-resistant terminal, comprising: 0.05 mass % P, a positive content of Sn not more than 1.7 mass %, a positive content of Fe not more than 0.15 mass %, a positive content of Zn not more than 0.1 mass %, Cu, and inevitable impurities.

An arc-resistant terminal comprising: not more than 0.03 mass % P, a positive content of C not more than 0.05 mass %, a positive content of Si not more than 1.5 mass %, a positive content of Mn not more than 2.0 mass %, a positive content of S not more than 0.03 mass %, a positive content of Cr not more than 1.5 mass %, a positive content of Fe not more than 0.4 mass %, Ni, and inevitable impurities.

An arc-resistant terminal comprising an electrical contact portion comprising at least 80 mass % of metal having a boiling point of not less than 1000 degrees centigrade, wherein the arc-resistant terminal capable of suppressing arc discharge upon terminal separation under conditions wherein a voltage between the arc-resistant terminal and a second terminal immediately after separation thereof is DC36V to 60V and the voltage and current values correspond to a point on FIG. 14 on or above curve A and on or below curve B. The arc-resistant terminal, further capable of suppressing arc discharge upon terminal separation under conditions wherein the current between terminals at the time of contact is 6 A to 30 A.

An arc-resistant terminal, wherein a content of the metal having a boiling point of not less than 1000 degrees centigrade is not less than 95 mass %. An arc-resistant terminal, wherein the metal having a boiling point of not less than 1000 degrees centigrade comprises at least one of Cu, Ni, Sn, Fe, Ag, Al, Au or Pt. An arc-resistant terminal, wherein the contact portion comprises a total content of not more than 0.4 mass % components having a boiling point of less than 1000 degrees centigrade.

An arc-resistant terminal, wherein the contact portion comprises not more than 0.4 mass % of components (excluding Ag, Al) having a boiling point lower than a boiling point of Sn. An arc-resistant terminal, the contact portion comprising not more than 0.15 mass % of a total content of Zn and P, a total content of components having a boiling point of less than 1000 degrees centigrade, or a total content of components (excluding Ag, Al) having a boiling point lower than a boiling point of Sn.

An arc-resistant terminal, the contact portion comprising not more than 10 mass % of Fe, W, Ag, and Al. An arc-resistant terminal, wherein the electrical contact portion comprises: not more than 0.4 mass % of Zn and P combined, not more than 10 mass % of Fe, Ag and Al combined, and at least one of Cu, Sn or Ni, and inevitable impurities. An arc-resistant terminal, wherein the electrical contact portion comprises: not more than 0.15 mass % of Zn and P combined, not more than 10 mass % of Fe, Ag and Al combined, and at least one of Cu, Sn or Ni, and inevitable impurities. An arc-resistant terminal, wherein the electrical contact portion comprises: not more than 0.4 mass % of Zn and P combined, not more than 10 mass % of Fe, Ag and Al combined, and one of Cu, Sn or Ni, and inevitable impurities.

An arc-resistant terminal, wherein the electrical contact portion comprises: not more than 0.15 mass % of Zn and P combined, not more than 0.2 mass % of Fe, and at least one of Cu, Sn or Ni, and inevitable impurities. An arc-resistant terminal, wherein the electrical contact portion comprises: not more than 0.4 mass % of Zn and P combined, not more than 0.2 mass % of Fe, and one of Cu, Sn or Ni, and inevitable impurities. An arc-resistant terminal, wherein the electrical contact portion comprises: Sn: 1.8 to 2.2 mass %, Fe: 0.05 to 0.12 mass %, P: 0.025 to 0.4 mass %, and Cu, and inevitable impurities.

A circuit comprising an electrical couple or connector comprising the arc-resistant terminal and a second terminal.

An arc-resistant terminal, wherein the electrical contact portion is plated with at least one of Sn, Ni, Au or Ag. An arc-resistant terminal, wherein the thickness of the plating at a distal end of the contact portion and the vicinity thereof is less than a thickness of plating on a main part of the contact portion (or absent).

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PREFERRED EMBODIMENTS

Figure 1:
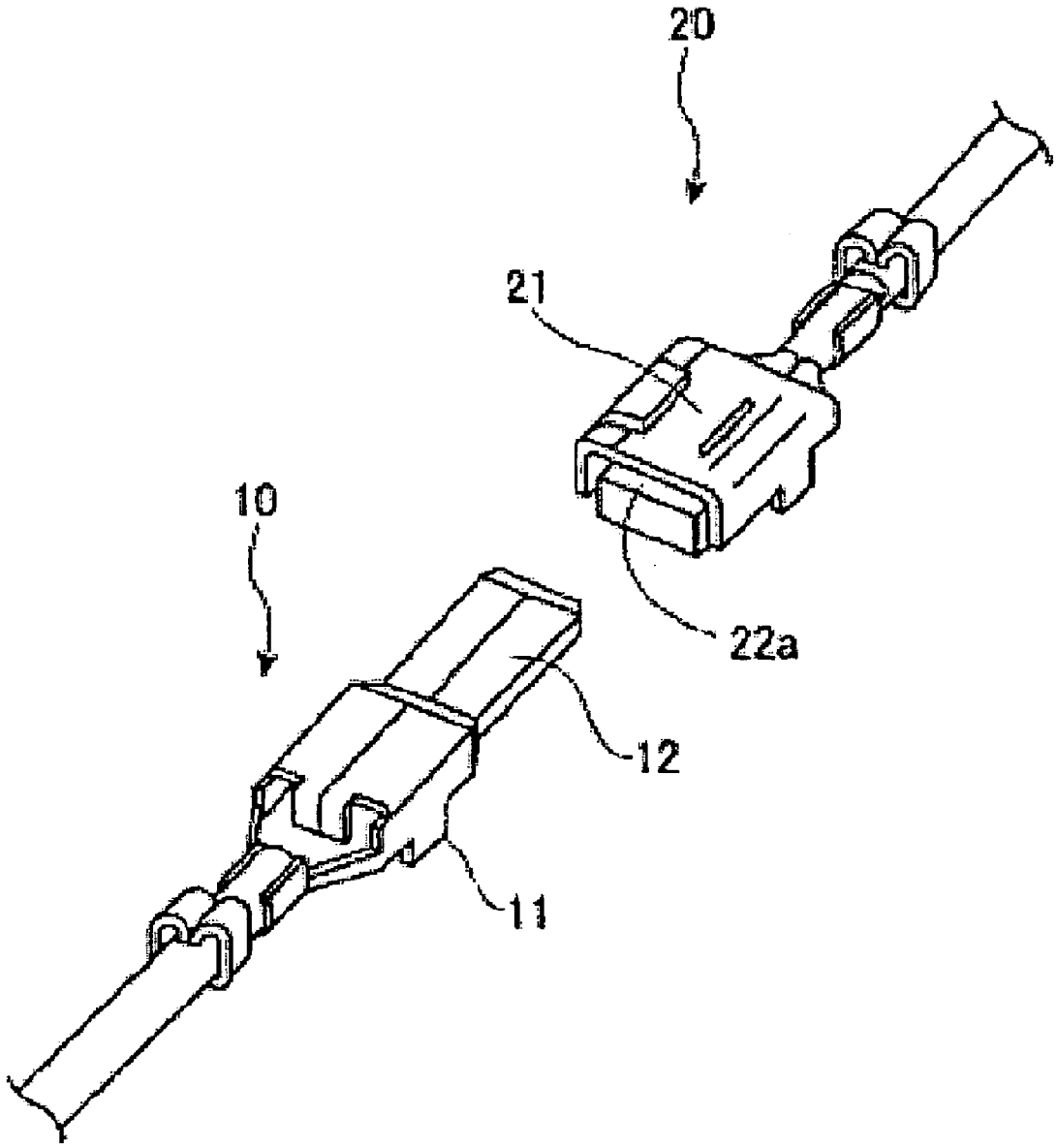
FIG. 1 is a schematic perspective view showing one example of a terminal of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The metal-based material which forms the above-mentioned base material or the above-mentioned final contact portion is explained. It is preferable that the above-mentioned metal-based material contains at least one kind of metal such as Cu, Ni and Sn, as a main component. This is because that Cu, Ni and Sn exhibit excellent arc resistance. Further, for example, in view of the strength, the weatherability, the workability or the like of the terminal, the above-mentioned metal-based material may contain components other than Cu, Ni and Sn. From a viewpoint of the arc resistance, it is preferable to suppress a quantity of these components to a value not more than a fixed quantity. For example, we provided:

(1) A Metal-based material in which a content of P is not more than 0.06 mass % and a balance that includes at least one kind of metal such Cu, Ni or Sn, and other constituent elements which are minute components which remain in the metal-based material, (also referred to as "inevitable impurities").

Since P is a component which remarkably reduces the arc resistance, a content of P is not more than 0.06 mass %, and more preferably not more than 0.04 mass %. Further, a content of P may be 0%. The above-mentioned balance includes one of Cu, Ni and Sn, or at least two or more kinds of metals selected from Cu, Ni and Sn, and further contains inevitable impurities. Particularly, from a viewpoint of the conductivity and the strength of terminal, it is preferable that the above-mentioned balance includes Cu in a single form or includes both Cu and Sn. Further, inevitable impurities are minute components which remain in the metal-based material and, for example, Zn, Cd, S, Pb, N and the like are named.

As the above-mentioned metal-based material (1), the following materials are named, for example.

(I) Metal-based material in which a content of P is 0% and the balance includes Cu and inevitable impurities.

(ii) Metal-based material in which a content of P is not more than 0.06 mass %, a content of Sn is not more than 6 mass % (not including 0%) and the balance includes Cu and inevitable impurities.

(iii) Metal-based material in which a content of P is not more than 0.05 mass %, a content of Sn is not more than 0.9 mass % (not including 0%), a content of Ni is not more than 1 mass % (not including 0%) and a balance includes Cu and inevitable impurities.

(2) A metal-based material in which a content of P is not more than 0.06 mass %, a total content of at least one kind of metal such as Fe, W, Ag, Al, Mo or Au is not more than 0.6 mass % (not including 0%) and a balance includes at least one kind of metal such as of Cu, Ni or Sn and inevitable impurities.

At least one kind of metal such as Fe, W, Ag, Al, Mo or Au is a metal which exhibits excellent arc resistance compared to Cu, Ni and Sn and hence, the metals are allowed to be contained in the metal-based material at a fixed quantity. Further, it is desirable that a total content of at least one kind of metal such as Fe, W, Ag, Al, Mo or Au is not more than 0.6 mass %, preferably not more than 0.4 mass %, and more preferably not more than 0.2 mass %. This is because that when the content exceeds 0.6 mass %, the arc-discharge resistance is reduced. The above-mentioned balance includes at least one kind of metal such as Cu, Ni or Sn and inevitable impurities. That is, the balance is formed of either one of Cu, Ni and Sn, or at least two or more kinds of metals such as Cu, Ni and Sn and inevitable impurities. From a viewpoint of the conductivity and the strength of terminal, it is preferable that the balance is constituted of Cu in a single form or is constituted of Cu and Sn. Further, although the inevitable impurities are not particularly limited, for example, Zn, Cd, S, Pb, N and the like are noted.

In the above-mentioned metal-based material, a content of components having a boiling point of less than 1000 degrees centigrade and more preferably, a content of components having a boiling point of less than 2000 degrees centigrade is not more than 1.5 mass %. The components having a boiling point of less than 2000 degrees centigrade are not limited to metal components. For example, non-metals such as P can be named as the component having a boiling point of less than 2000 degrees centigrade besides metal such as Mg, Pb, Zn. Since it is considered that the components having a boiling point of less than 2000 degrees centigrade are liable to be easily evaporated due to the generation of heat attributed to the application of a high voltage or a high current and become a cause of an arc discharge, a content of the components having a boiling point of less than 2000 degrees centigrade in the metal-based material is set to not more than 1.5 mass %, preferably not more than 0.4 mass %, and more preferably not more than 0.15 mass %.

Among the components having a boiling point of less than 2000 degrees centigrade, Zn and P may be contained in a metal-based material which contains Cu as a main component although an amount of Zn and P is minute. For example, since zinc is alloyed with copper and exhibits an effect to increase the strength of the alloy, there may be a case that the a minute quantity of zinc is contained in the metal-based material. Further, phosphorous is a residue of phosphorous which is added at the time of deoxidating oxygen contained in copper. However, when a content of Zn and P is increased, arc resistance is decreased and hence, it is desirable that a total content of Zn and P is not more than 0.4 mass % and, preferably not more than 0.15 mass %.

As boiling points of respective components according to the present invention, boiling points described in Kagaku Binran (the Fourth Edition, 8.4 Vapor Pressure of pure substances, Table 8.26, page 118 to page 121, the Basic Chapter II, the Fourth Edition edited by Nihon Kagaku Kyokai) are adopted. For example, W (boiling point: 5927 degrees centigrade), Mo (boiling point: 4804 degrees centigrade), Au (boiling point: 2966 degrees centigrade), Fe (boiling point: 2735 degrees centigrade), Ni (boiling point: 2732 degrees centigrade), Cu (boiling point: 2595 degrees centigrade), Sn (boiling point: 2270 degrees centigrade), Ag (boiling point: 2212 degrees centigrade), Al (boiling point: 2056 degrees centigrade), Pb (boiling point: 1744 degrees centigrade), Mg (boiling point: 1107 degrees centigrade), Zn (boiling point: 907 degrees centigrade), P (boiling point: 208.3 degrees centigrade), Cr (boiling point: 2842 degrees centigrade), Mn (boiling point: 2151 degrees centigrade), Si (boiling point: 2287 degrees centigrade) and the like can be adopted.

It is preferable that the balance of the above-mentioned metal-based material is at least one kind of metal such as Fe, W, Ag, Al, Mo or Au. These metals exhibit excellent arc resistance compared to metals including Cu, Ni and Sn, and it is allowed to contain these metals as the balance of the above-mentioned metal-based material at a fixed quantity. Although a content of the balance is not particularly limited, it is preferably not more than 5 mass %, more preferably not more than 3 mass %, and still more preferably not more than 0.2 mass %.

As preferred mode of the above-mentioned metal-based material (2), following are noted:

(i) A metal-based material in which a content of P is not more than 0.06 mass %, a content of Fe is not more than 0.4 mass % (not including 0%) and a balance includes at least one kind of metal such as Cu, Ni or Sn and inevitable impurities. By including a minute content of Fe in the metal-based material, it is possible to obtain the terminal having high spring characteristics without lowering the arc resistance.

(ii) A metal-based material in which a content of P is 0.025 to 0.04 mass %, a content of Fe is 0.05 to 0.15 mass %, a content of Sn is 1.8 to 2.2 mass % and a balance includes Cu and inevitable impurities.

(iii) A metal-based material in which a content of P is not more than 0.06 mass %, a content of Ag is not more than 0.6 mass % (not including 0%) and a balance includes Cu and inevitable impurities.

(3) Other metal-based materials:

In the present invention, the metal-based material which forms the base material or the final contact portion of the electrical contact portion is not limited to the above-mentioned metal-based material and can be changed as follows, for example:

(i) A metal-based material in which a content of P is 0.05 mass %, a content of Sn is not more than 1.7 mass % (not including 0%), a content of Fe is not more than 0.15 mass % (not including 0%), a content of Zn is not more than 0.1 mass % (not including 0%) and a balance includes Cu and inevitable impurities.

(ii) A metal-based material in which a content of P is not more than 0.03 mass %, a content of C is not more than 0.05 mass % (not including 0%), a content of Si is not more than 1.5 mass % (not including 0%), a content of Mn is not more than 2.0 mass % (not including 0%), a content of S is not more than 0.03 mass % (not including 0%), a content of Cr is not more than 1.5 mass % (not including 0%), a content of Fe is not more than 0.4 mass % (not including 0%), and a balance includes Ni and inevitable impurities.

(iii) A metal-based material in which a content of P is not more than 0.06 mass %, a content of Be is not more than 2 mass % (not including 0%) and a balance includes Cu and inevitable impurities.

(iv) A metal-based material in which a content of P is not more than 0.045 mass %, a content of C is not more than 0.08 mass %, a content of Si is not more than 1 mass %, a content of Mn is not more than 2 mass %, a content of S is not more than 0.030 mass %, a content of Ni is 8.00 to 10.50 mass %, a content of Cr is 18 to 20 mass %, and a balance includes Fe and inevitable impurities.

In the above-mentioned modes, Si, Fe, Zn, Cr, Mn, Ni, Be and the like can enhance the spring characteristics of the terminal. Particularly, with the use of the metal-based material formed of the combination of Si and Ni, it is possible to obtain the terminal which has the high spring characteristics. Further, the above-mentioned metal-based material (iv) is so-called SUS 304 (containing Fe as a main component) and hence, the metal-based material (iv) exhibits excellent arc-resistance. However, to take the conductivity into account, it is preferable to use the metal-based material which contains Cu as a main component.

Figure 14:
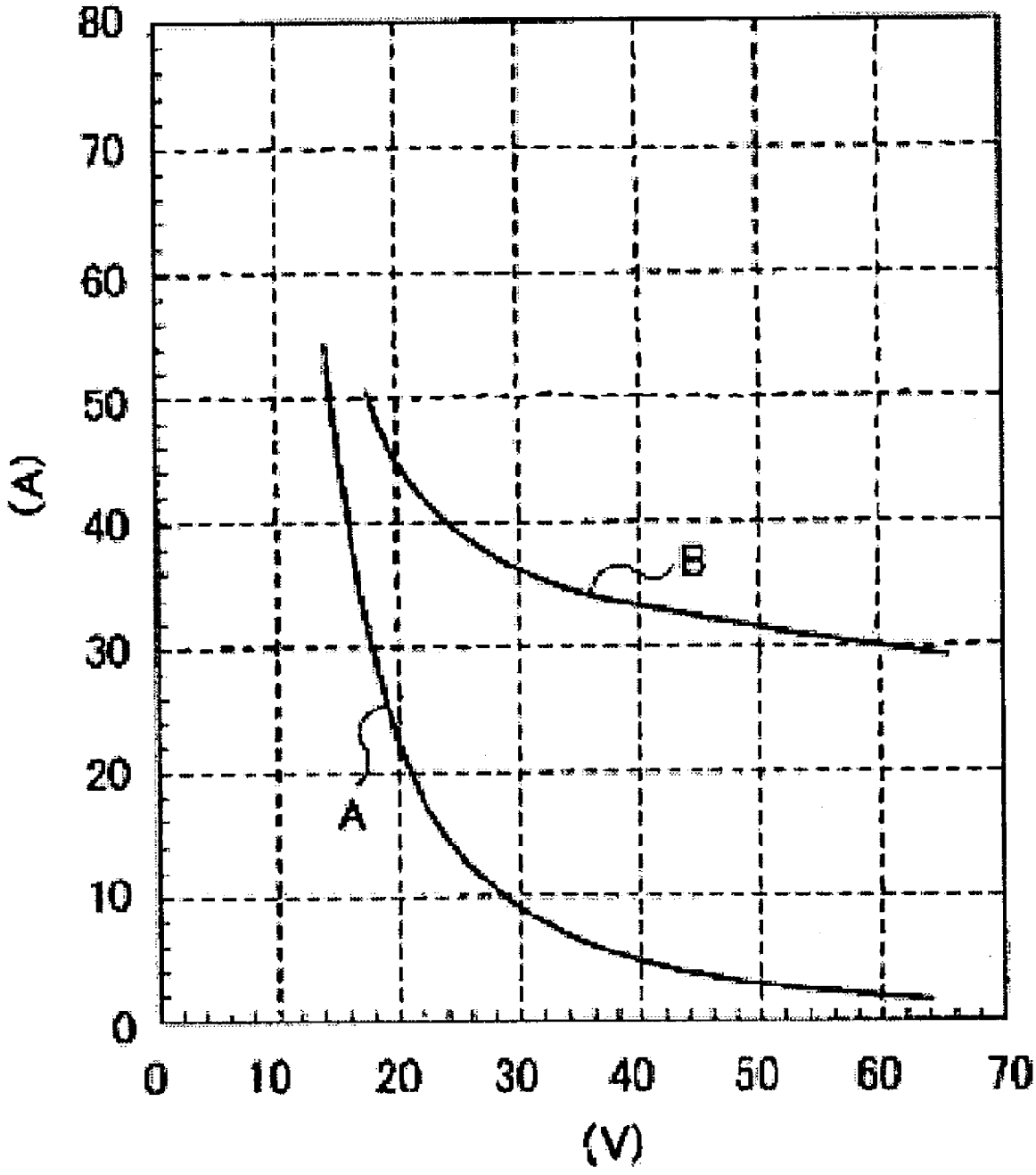
FIG. 14 is a graph showing a range in which the present invention is applicable.

Referring to the drawings wherein like characters represent like elements, FIG. 14 is a graph explaining the relationship between a voltage applied between terminals immediately after a terminal couple are separated (hereinafter also simply referred to as "voltage between terminals") and a current which flows between terminals when the terminal couple are brought into contact with each other (hereinafter also simply referred to as "current between terminals"). Then, a curve A in FIG. 14 indicates a boundary for determining whether a large arc discharge (arc discharge having energy of not less than 15 J) is generated or not when brass is used as the base material of the electrical contact portion. Further, a curve B in FIG. 14 indicates a boundary for determining whether a large arc discharge (arc discharge having energy of not less than 15 J) is generated or not when the base material of the electrical contact portion is made of the metal-based material which contains not less than 80 mass % of at least one kind of metal such as Cu, Ni or Sn and contains not more than 1.5 mass % of components having a boiling point of less than 2000 degrees centigrade. Accordingly, when the voltage between terminals and the current between terminals are operated in a range sandwiched by the curve A and the curve B in FIG. 14, although a large arc discharge is generated when the brass is used as the base material, the arc discharge can be remarkably suppressed when the above-mentioned metal-based material is used as the base material. Here, in a low-current/low-voltage side as viewed from the curve A in FIG. 14, an arc discharge is hardly generated irrespective of the use of brass and the above-mentioned metal-based material as the base material, while in a high-current/high-voltage side as viewed from the curve B in FIG. 14, although the above-mentioned metal-based material exhibits a smaller value with respect to an energy quantity of arc thereof than brass, irrespective of brass or the above-mentioned metal-based material, a large arc discharge which gives a large damage to both of brass and the above-mentioned metal-based material is generated.

The arc-resistant terminal of the present invention is not limited to the above-mentioned description and may be changed any of the following manners:

(1) An arc-resistant terminal, wherein a base material of an electrical contact portion is formed of a metal-based material in which a content of Cu is not less than 90 mass % and a total content of Zn and P is not more than 0.4 mass % (including 0 mass %), and the arc-resistant terminal is served for an application in which a voltage between terminals immediately after separation assumes DC 36 V and a current between terminals at the time of contact falls in a range of 7 A to 30 A. Here, it is preferable that in the above-mentioned metal-based material, a total content of Zn and P is not more than 0.15 mass %. Further, it is preferable that in the metal-based material, a total content of a component having a boiling point lower than a boiling point of Sn (excluding Ag, Al) is not more than 0.4 mass % (including 0 mass %), and more preferably not more than 0.15 mass %. All of these modes are taken to suppress the content of Zn and P in view of the fact that these components are considered to easily generate an arc discharge. In the same manner, it is preferable that in the metal-based material, a total content of a component having a boiling point of less than 1000 degrees centigrade is not more than 0.4 mass % (including 0 mass %), and more preferably not more than 0.15 mass %. A balance of the metal-based material is, for example, at least one kind of metal such as Fe, W, Ag, Al, Mo or Au and inevitable impurities. At least one kind of metal such as Fe, W, Ag, Al, Mo or Au exhibits relatively excellent arc resistance and hence, the metal is allowed to be contained in the metal-based material at a fixed quantity. It is preferable that the balance is not more than 5 mass %, and more preferably not more than 0.2 mass % since it is desirable to decrease a content of the above-mentioned balance and to increase a content of Cu in view of the arc resistance. Here, as the above-mentioned inevitable impurities, components of extremely minute quantity which are mixed into the metal-based material in processes such as recycling or refining are considered.

(2) An arc-resistant terminal, wherein a base material of an electrical contact portion thereof is formed of a metal-based material in which a total content of Zn and P is not more than 0.40 mass % (including 0 mass %), a total content of Fe, Ag and Al is not more than 10 mass % (including 0 mass %), and a balance includes at least one kind of metal selected from Cu, Sn and Ni and inevitable impurities, and the arc-resistant terminal is served for an application in which a voltage between terminals immediately after separation assumes DC 36 V and a current between terminals at the time of contact falls in a range of 7 A to 30 A.

(3) An arc-resistant terminal, wherein a base material of an electrical contact portion thereof is formed of a metal-based material in which a total content of Zn and P is not more than 0.40 mass % (including 0 mass %), a content of Fe is not more than 0.2 mass % (including 0 mass %), and a balance includes one kind of metal selected from Cu, Sn and Ni and inevitable impurities, and the arc-resistant terminal is served for an application in which a voltage between terminals immediately after separation assumes DC 36 V and a current between terminals at the time of contact falls in a range of 7 A to 30 A. It is preferable that a total quantity of the above-mentioned Zn and P is not more than 0.15 mass % (including 0 mass %).

(4) An arc-resistant terminal is a terminal, wherein a base material of an electrical contact portion thereof is formed of a metal-based material which contains Sn: 1.8 to 2.2 mass %, Fe: 0.05 to 0.12 mass %, P: 0.025 to 0.40 mass %, and Cu and inevitable impurities as a balance, and the arc-resistant terminal is served for an application in which a voltage between terminals immediately after separation assumes DC 36 V and a current between terminals at the time of contact falls in a range of 7 A to 30 A. Since the base material is formed of the metal-based material containing Cu, Sn and Fe, it is possible to obtain the terminal which exhibits excellent strength and excellent arc resistance.

Figure 2:
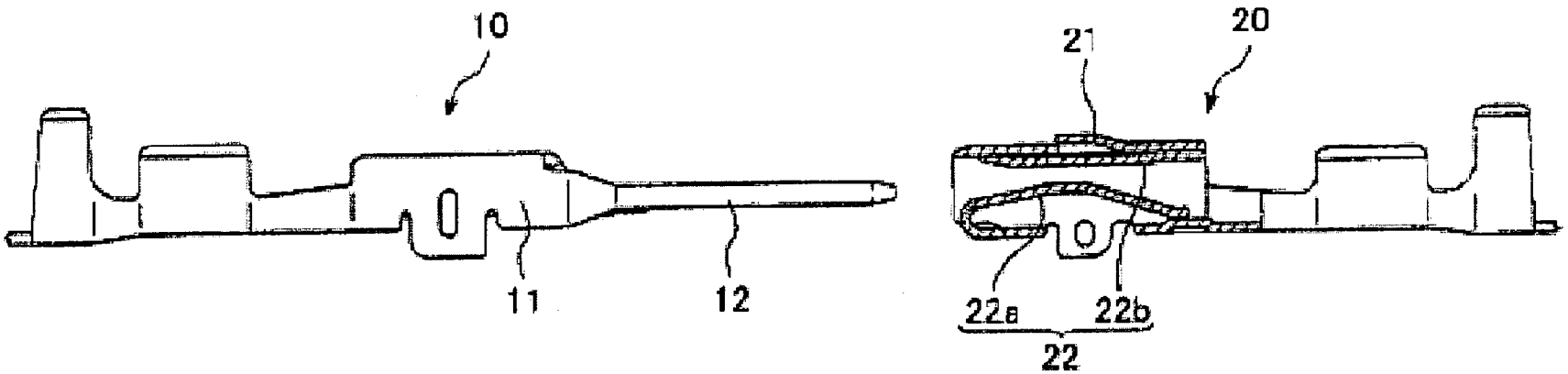
FIG. 2 is a schematic side view with a part broken away of the terminal shown in the above-mentioned FIG. 1.
Figure 3:
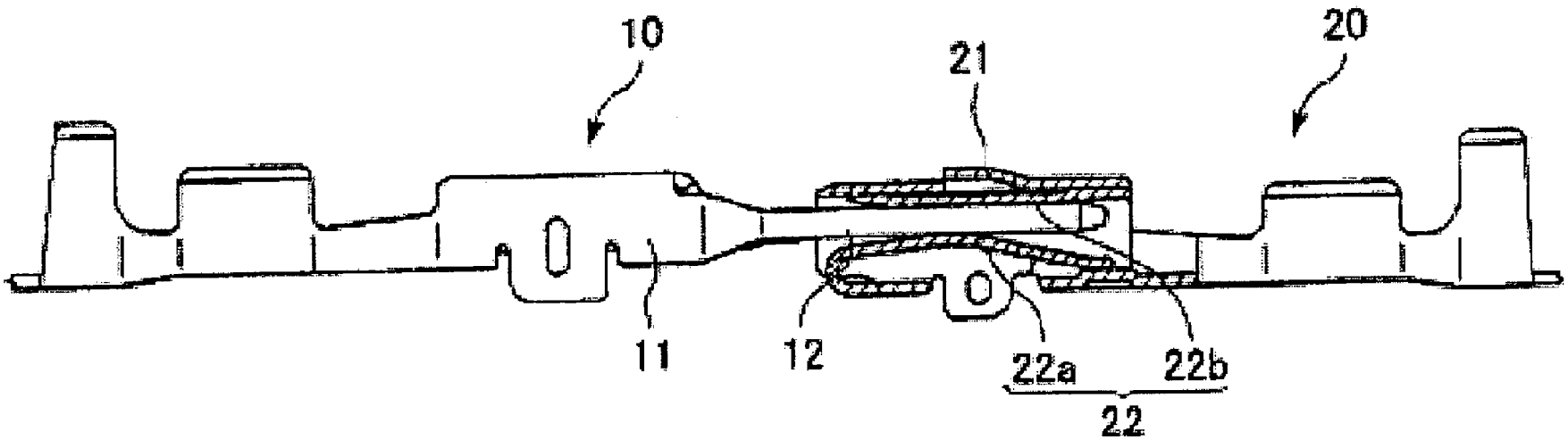
FIG. 3 is a schematic side view with a part broken away showing a fitting engagement state of a terminal shown in FIG. 2.

FIG. 1 is a schematic perspective view showing a male terminal and a female terminal for an automobile connector as an example of the present invention, FIG. 2 is a side view with a part broken away of the terminal couple, and FIG. 3 is a side view with a part broken away of the terminal couple in a fitting engagement state.

As shown in FIG. 1 and FIG. 3, a male terminal 10 includes a box-shaped portion 11 which constitutes a terminal body and a male-type electrical contact portion (male tab) 12 which is extended in the frontward direction from the box-shaped portion 11. The male terminal 10 constitutes a male-type connector together with a resin-made housing (not shown in the drawing). On the other hand, a female terminal 20 includes a box-shaped portion 21, wherein a contact spring lug 22*a* and a second contact lug 22*b* which faces the spring lug 22*a* in an opposed manner and is capable of sandwiching the above-mentioned male tab 12 are formed inside the box-shaped portion 21. The female terminal 20 is also housed in a resin-made housing (not shown in the drawing) in the same manner as the above-mentioned male terminal 10 thus constituting a female type connector. Then, as shown in FIG. 3, by putting both terminals 10, 20 into fitting engagement, the above-mentioned male tab 12 and the female type electrical contact portion 22 which includes the above-mentioned contact spring lug 22*a* and the second contact lug 22*b* are brought into contact with each other and an electrically conductive state is obtained between both terminals 10, 20 by such a contact.

Here, when the conventional male terminal 10 and the female terminal 20 in which a base material of electrical portions thereof is made of brass are separated in the application where the voltage between terminals is not less than 36V and the current between terminals is not less than 6 A, an arc discharge is generated between the male tab 12 and the female-type contact portion 22. That is, when the male terminal 10 is about to be removed in a rearward direction from the female terminal 20, first of all, the male tab 12 and the contact spring lug 22*a* are separated and, subsequently, the male tab 12 and the second contact lug 22*b* are separated. Then, when the male terminal 10 and the female terminal 20 are separated finally, that is, when the male tab 12 and the second contact lug 22*b* are separated in the example shown in FIG. 1 to FIG. 3, there is a fear that an arc discharge is generated between both terminals thus damaging both terminals.

In the present invention, the base material of the above-mentioned male tab 12 and female-type contact portion 22 is made of the above-mentioned particular metal-based material which contains not less than 80 mass % in total of at least one kind of metal such as Cu, Ni or Sn and in which a content of the components having a boiling point of less than 2000 degrees centigrade is not more than 1.5 mass %. Accordingly, even in the application in which the voltage between terminals assumes 36 V to 60 V and the current between terminals assumes 6 A to 30 A, the male tab 12 and the female-type contact portion 22 exhibit excellent arc resistance. Further, in the present invention, it is not always necessary to form the whole electrical contact portion using the above-mentioned metal-based material. The above-mentioned final contact portion may be formed of the above-mentioned metal-based material which contains not less than 80 mass % in total of at least one kind of metal such as Cu, Ni or Sn and in which a content of the components having a boiling point of less than 2000 degrees centigrade is not more than 1.5 mass %. That is, an arc discharge is liable to be easily generated at the portion which is lastly separated when the terminal is separated (final contact portion) and hence, it is sufficient that at least the above-mentioned final contact portion is formed of the above-mentioned metal-based material.

Figure 7:
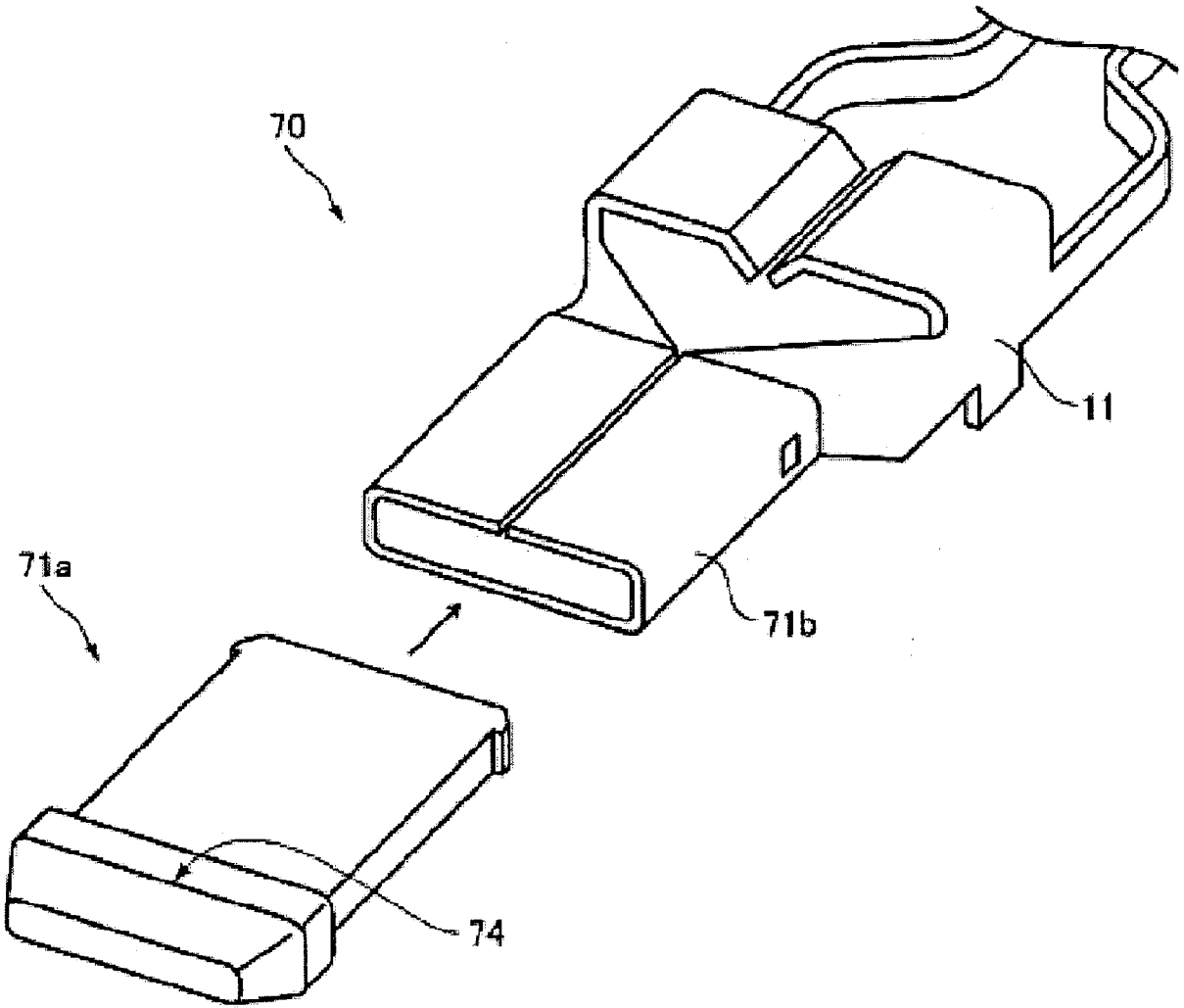
FIG. 7 is a schematic perspective view showing another example of the terminal of the present invention.

FIG. 7 is a schematic assembling perspective view showing one example of such terminals. That is, in this illustrated example, an electrical contact portion of a male terminal 70 is formed of two parts including a distal-end side part 71*a* and a rear-end side part 71*b*, wherein the rear-end side part 71*b* is integrally formed with a box-shaped portion 11. In this example, the above-mentioned rear-end side part 71*b* has an approximately cylindrical shape, a portion of the above-mentioned distal-end side part 71*a* is fitted into the cylindrical part 71*b*, and the cylindrical part 71*b* is caulked whereby the male terminal 70 can be assembled. In such a terminal having a plurality of parts, a part which has the final contact portion (the distal-end side part 71*a* in this example) may be formed of the above-mentioned metal-based material and other parts may be formed using other material (brass or the like, for example). Here, the number of the parts is not limited to two and may be set to three or more. Further, a method for joining parts is not limited to caulking and various known means can be adopted.

Figure 4:
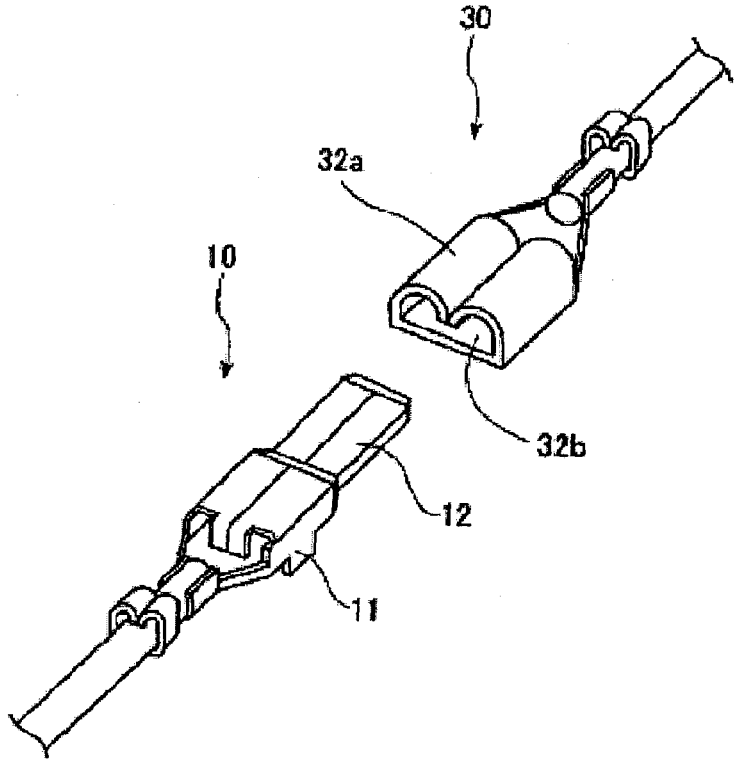
FIG. 4 is a schematic perspective view showing another example of the terminal of the present invention.

The shape of the arc-resistant terminal is not particularly limited and the terminal can have shapes which are usually used. FIG. 4 is a schematic perspective view showing a terminal couple having shapes different from the example shown in FIG. 1 to FIG. 3. That is, although the example shown in FIG. 4 has the same configuration compared to the example shown in the above-mentioned FIG. 1 to FIG. 3 with respect to the male terminal 10, the example shown in FIG. 4 differs from the example shown in FIG. 1 to FIG. 3 with respect to a point that a female terminal 30 is formed of semi-cylindrical contact resilient lugs 32*a* and a second contact lug 32*b* which faces the resilient lugs 32*a* in an opposed manner and is capable of sandwiching the above-mentioned male tab 12. According to the present invention, irrespective of the shape of the terminal, it is possible to enhance the arc resistance by forming the base material of the electrical contact portion using the above-mentioned metal-based material.

Further, a surface of the base material of the electrical contact portion of the arc-resistant terminal according to the present invention may be plated with at least one kind of metal such as Sn, Ni, Au, or Ag, because the corrosion resistance can be enhanced by applying plating on the electrical contact portion and the conductive contact characteristics (contact area) of the electrical contact portion can be enhanced when a plating layer is soft. On the other hand, according to the present invention, the base material of the electrical contact portion or the final contact portion per se exhibits excellent arc resistance and hence, when plating is applied to such a portion, the characteristics of the base material or the like cannot be utilized to the maximum.

Accordingly, it is preferable to apply thin plating or no plating to a portion where an arc discharge is liable to be generated (portion which is separated lastly when the terminals are separated (final contact portion)) and the vicinity thereof. Then, with respect to a portion other than the above-mentioned final contact portion and the vicinity thereof, when the portion is brought into contact with a counterpart electrical contact portion at the time of main fitting engagement, plating having a thickness larger than a thickness of the above-mentioned final contact portion is preferably applied to this main contact portion.

Figure 8:
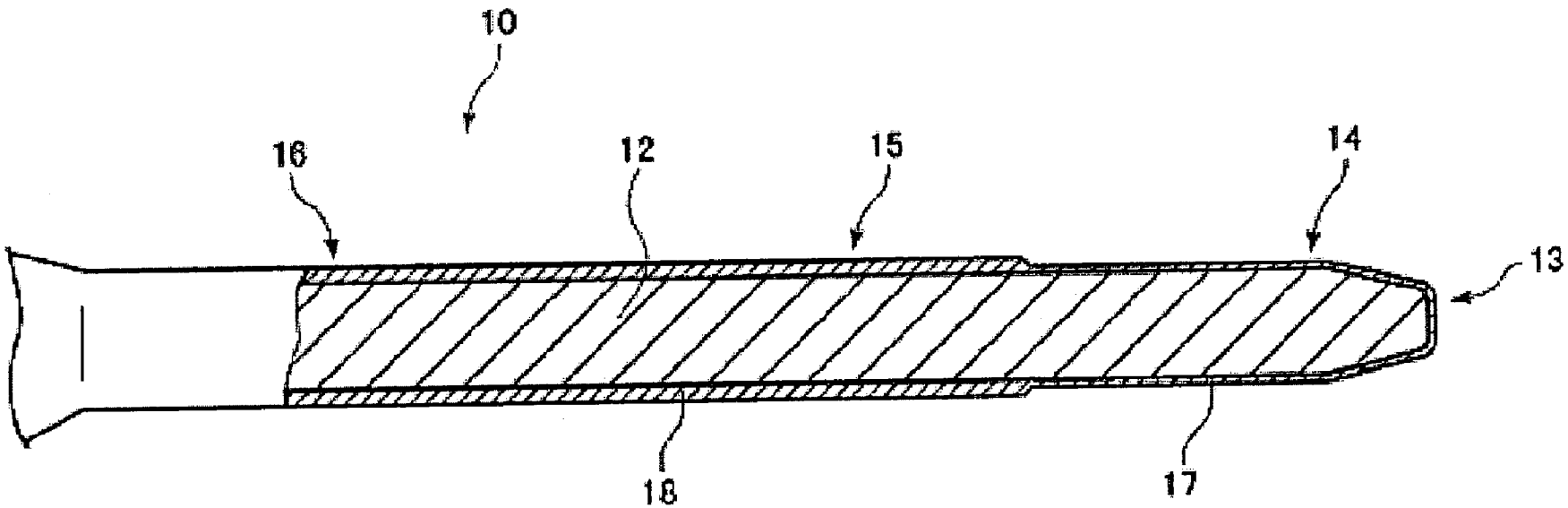
FIG. 8 is a partially enlarged cross-sectional view showing still another example of the terminal of the present invention.

For example, when such plating which changes a thickness thereof is applied to the male tab (male-type electrical contact portion) 12 used in the above-mentioned FIG. 1 to FIG. 4, a schematic cross-sectional view shown in FIG. 8 is obtained. That is, in this male tab 12, since the final contact portion 14 is arranged in the vicinity of the distal end portion 13, a thin plating 17 is applied to the vicinity of the distal end portion 13. Further, in this male tab 12, a thick plating 18 is applied to the main contact portion 15. In this example, the thick plating 18 is applied to the portion other than the vicinity of the above-mentioned distal end portion 13 including a proximal side 16. Although the explanation is made in detail with respect to plating based on the illustrated example hereinafter, the same goes for other terminal.

The thin plating portion 17 (or the non-plating portion) includes the final contact portion 14 and can be formed to an extent that the portion does not substantially impede the arc resistance of the base material. It is preferable that the thin plating portion 17 or the non-plating portion includes at least following regions:

A region within a distance of 1 mm from the final contact portion 14; Preferably, a region within a distance of 3 mm from the final contact portion 14; or More preferably, a region within a distance of 5 mm from the final contact portion 14.

On the other hand, from a viewpoint of corrosion resistance and the like, it is preferable to reduce the thin plating portion 17 (or the non-plating portion) and the thin plating portion 17 (or the non-plating portion) may be set within following ranges, for example:

A region within a distance of 10 mm from the final contact portion 14; Preferably, a region within a distance of 8 mm from the final contact portion 14; or More preferably, a region within a distance of 5 mm from the final contact portion 14.

Here, with respect to the male terminal, the distal end portion 13 or the vicinity thereof usually constitutes the final contact portion 14 in many cases. Accordingly, it is convenient to set the thin plating (or the non-plating) within a length of approximately 8 to 10 mm, preferably within a length of approximately 5 to 8 mm, and more preferably within a length of approximately 3 to 5 mm in the direction toward the proximal-end from the distal end portion.

Metal for the above-mentioned plating can be selected from a range which does not substantially damage the arc resistance of the electrical contact portion and various conventionally used plating can be applied. That is, so long as the arc resistance is not practically damaged, plating may be applied using metal which exhibits the inferior arc resistance than the metal which constitutes the base material. However, it is preferable to select the metal from Cu, Sn, Ni, Au, Ag and the like. By selecting these metals for plating, a risk that the arc resistance is lowered can be reduced.

Although Sn and Ni exhibit inferior arc resistance compared to Cu in a strict sense, the arc resistance of the electrical contact portion is not substantially reduced.

A plating thickness of the thin plating portion (and non-plating portion) is, for example, approximately 0 to 0.5 μm, preferably, approximately 0 to 0.3 μm, and more preferably, approximately 0 to 0.2 μm. Although a plating thickness of the thick plating portion is not particularly limited provided that the plating thickness is larger than the plating thickness of the above-mentioned thin plating portion, the plating thickness of the thick plating portion is, for example, not less than 1 μm, preferably not less than 2 μm, and more preferably not less than 3 μm. Here, the plating thickness is usually approximately not more than 5 μm and is approximately not more than 3 μm in many cases. Although a method which applies the thin plating to the vicinity of the final contact portion and the thick plating to the main contact portion is not particularly limited, for example, a method which applies plating in two stages, a method which separately manufactures the final contact portion and the main contact portion and separately applies platings to these contact portions and, thereafter, joins these contact portions and the like are named.

The arc-resistant terminals of the present invention can be used as, for example, an arc-resistant couple, wherein respective arc-resistant terminals constitute a male terminal and a female terminal. Further, the arc-resistant terminal of the present invention is, for example, applicable to a connector or the like for an automobile such as a connector for an automobile or an electrical junction box (joint box or the like) provided with a connector portion or a relay or a motor which is provided with a connector portion for connection with an external circuit. Here, the connector portion for connection with the external circuit may be incorporated in a body of the relay or the motor.

Figure 5:
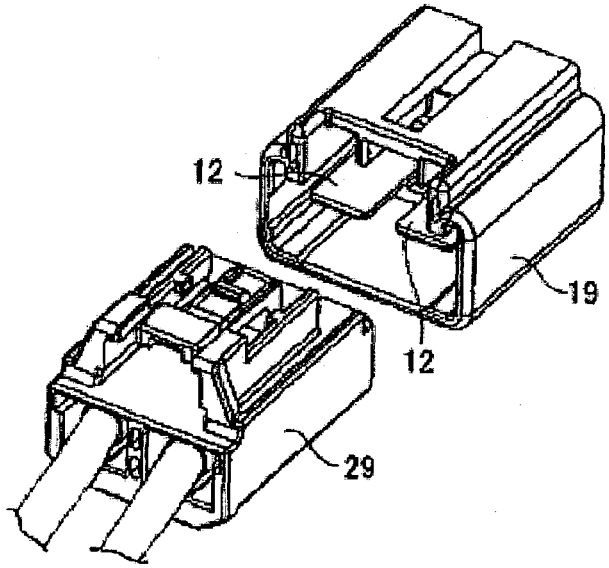
FIG. 5 is a schematic perspective view showing one example of a connector of the present invention.

FIG. 5 is a schematic perspective view showing one example of the connector of the present invention. That is, in the inside of one connector 19, a male terminal which includes a plurality of (two in this example) male tabs (male-type electrical contact portions) 12 is housed. On the other hand, in the inside of another connector 29, a female terminal which includes a plurality of female type electrical contact portions which are engaged with the above-mentioned male tabs 12 by fitting is housed. Then, along with the fitting engagement of the terminals, the connectors 19, 29 are also engaged with each other by fitting. Also in such connectors, by applying the terminal of the present invention to at least one of (preferably both of) the male terminal and the female terminal, it is possible to obtain a favorable arc suppression effect.

Figure 6:
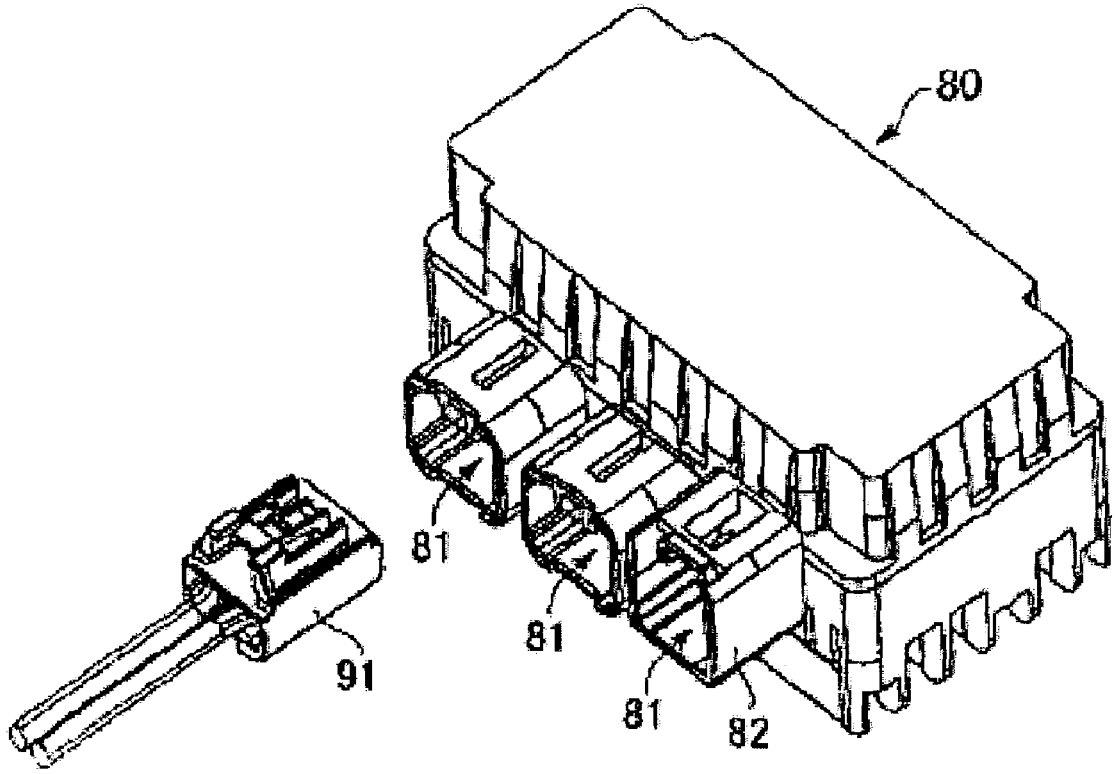
FIG. 6 is a schematic perspective view showing one example of an electrical junction box of the present invention.
Figure 12:
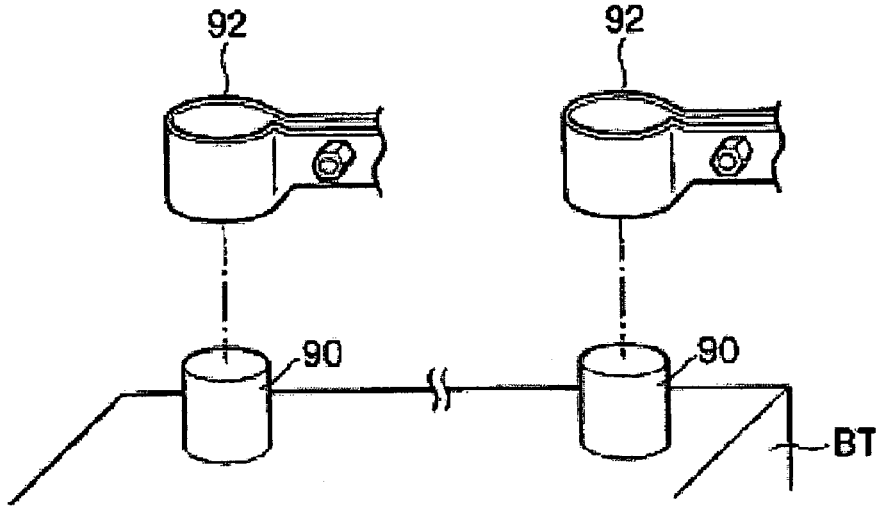
FIG. 12 is a partially enlarged perspective view illustrating a battery terminal of the present invention.

FIG. 6 is a schematic perspective view showing one example of an electrical junction box of the present invention. The electrical junction box 80 of this example houses a bus bar wiring portion therein and, at the same time, includes a plurality of (three in this example) connector portions 81 which come into contact with the bus bar wiring portion and are exposed to the outside. In each connector portion 81, a terminal which is projected from the bus bar wiring portion is housed in the inside of a hood 82 formed on a casing of the electrical junction box 80. Also in such an electrical junction box, by applying the terminal of the present invention to at least one of (preferably both of) the terminals of the connector portions 81 and a terminal of a connector 91, it is possible to obtain a favorable arc suppression effect. FIG. 12 is a schematic perspective view illustrating a case in which the arc-resistant terminal of the present invention is used as terminals for a battery. By applying the terminal of the present invention to at least either one of (preferably both of) a battery-connection-use terminal 92 and an electrode terminal 90 of a battery BT, it is possible to obtain a favorable arc suppression effect.

Figure 13:
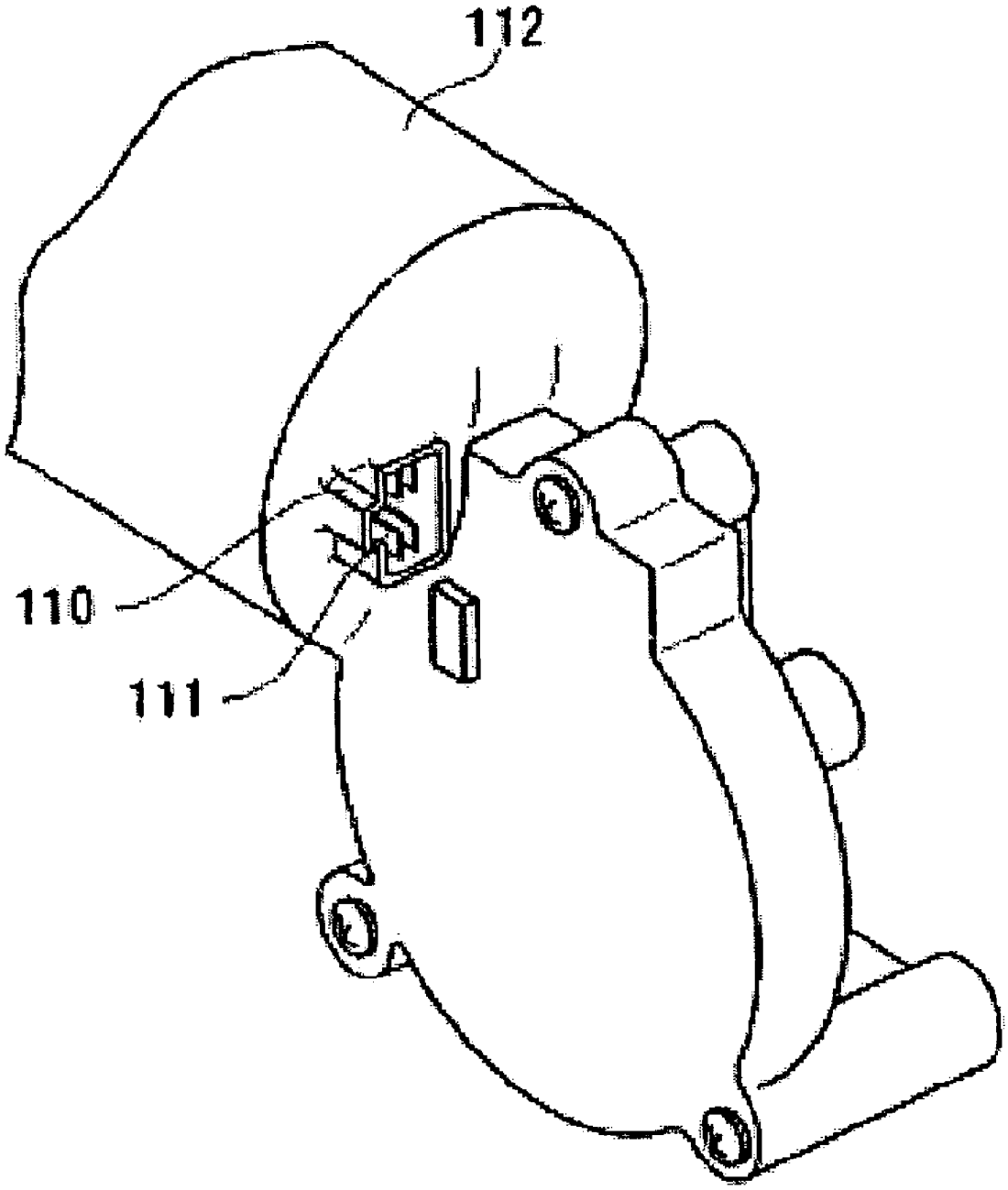
FIG. 13 is a schematic perspective view for illustrating a mode in which the terminal of the present invention is applied to a connector portion provided to a motor.

FIG. 13 is a schematic perspective view for illustrating a case in which the arc-resistant terminal of the present invention is applied to a motor having a connector portion 110 for connection with an external circuit. The connector portion 110 for connection with an external circuit is configured such that the connector portion 110 is incorporated in a motor body 112. It is possible to use the arc-resistant terminal of the present invention as a terminal 111 of the connector portion 110.

The present invention is explained more specifically with reference to examples. However, it is needless to say that the present invention is not limited by the following examples and can be naturally exercised by properly adding changes within a scope which complies with the gist of the present invention described above and hereinafter, and all of these modifications are also included within a technical scope of the present invention.

Preparation of Terminal and Terminal Model

As materials of the base material of the electrical contact portion, the metal-based materials shown in Table 1 to Table 3 are used and round-bar type terminal models having a diameter of 2 mm to 2.6 mm or TS2.3 type terminal couples shown in FIG. 1 are prepared. In case of the TS2.3 type terminal couples, a Sn plating having a thickness of approximately 1 μm is applied to a surface of an electrical contact portion of each terminal. The metal-based materials formed of a single component are shown in Table 1 and the metal-based materials formed of an alloy are shown in Table 2 and Table 3.

TABLE 1

| metal-based material | component | boiling point (° C.) |
|---|---|---|
| material 1 | pure Cu | 2595 |
| material 2 | pure Ni | 2732 |
| material 3 | pure Sn | 2270 |
| material 4 | pure Fe | 2735 |
| material 5 | pure W | 5927 |
| material 6 | pure Ag | 2212 |
| material 7 | pure Al | 2056 |
| material 8 | pure Mo | 4804 |
| material 9 | pure Au | 2966 |
| material 10 | pure Zn | 907 |
| material 11 | pure Mg | 1107 |
| material 12 | pure Pb | 1744 |

TABLE 2

| | composition of metal-based material (mass %) | | | | | | | |
|---|---|---|---|---|---|---|---|---|
| component | material 13 | material 14 | material 15 | material 16 | material 17 | material 18 | material 19 | material 20 |
| Cu | balance | balance | balance | 94 | — | balance | — | balance |
| Ni | — | 1 | — | — | balance | — | 8–10.5 | — |
| Sn | 1.8–2.2 | 0.9 | 1.7 | approximately 6 | — | — | — | — |
| Fe | 0.05–0.15 | — | 0.15 | — | not more than 0.4 | — | balance | — |
| Ag | — | — | — | — | — | 0.6 | — | — |

TABLE 2-continued

| component | composition of metal-based material (mass %) | | | | | | | |
|---|---|---|---|---|---|---|---|---|
| | material 13 | material 14 | material 15 | material 16 | material 17 | material 18 | material 19 | material 20 |
| Al | — | — | — | — | — | — | — | — |
| Zn | — | — | 0.1 | — | — | — | — | — |
| P | 0.025–0.04 | 0.05 | 0.05 | not more than 0.06 | not more than 0.03 | not more than 0.06 | not more than 0.045 | not more than 0.06 |
| Cr | — | — | — | — | 1.5 | — | 18–20 | — |
| C | — | — | — | — | not more than 0.05 | — | not more than 0.08 | — |
| Si | — | — | — | — | 1.5 | — | not more than 1.00 | — |
| Mn | — | — | — | — | 2.0 | — | not more than 2.00 | — |
| S | — | — | — | — | not more than 0.03 | — | not more than 0.030 | — |
| Be | — | — | — | — | — | — | — | 2 |
| remarks | — | — | — | phosphor bronze | SCN | — | SUS304 | — |

TABLE 3

| component | composition of metal-based material (mass %) | | | | |
|---|---|---|---|---|---|
| | material 21 | material 22 | material 23 | material 24 | material 25 |
| Cu | balance | balance | 0.015 | 65 | balance |
| Ni | — | — | 75.6 | — | — |
| Sn | — | — | — | — | — |
| Fe | — | — | 7.7 | — | 2.1 |
| Ag | — | — | — | — | — |
| Al | — | — | 0.3 | — | — |
| Zn | — | — | — | 35 | 2 |
| P | 0.06 | 0.08 | 0.006 | — | 0.03 |
| Cr | — | — | 15.4 | — | — |
| C | — | — | 0.045 | — | — |
| Si | — | — | 0.2 | — | — |
| Mn | — | — | 0.3 | — | — |
| S | — | — | 0.002 | — | — |
| Be | — | — | — | — | — |
| remarks | — | — | balance: Ti and the like | brass | — |

Arc-Discharge Resistance

Figure 9:
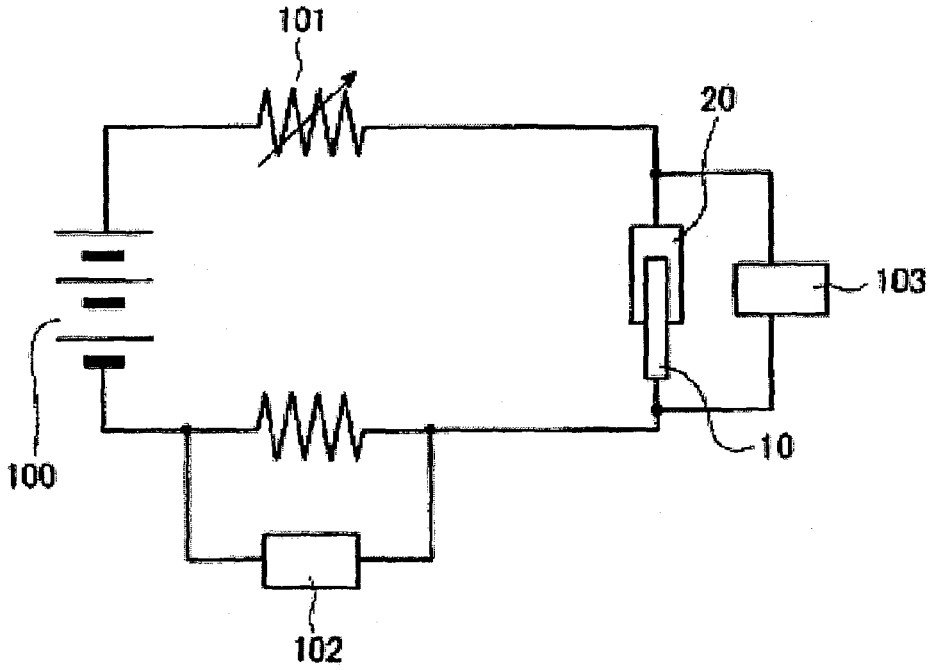
FIG. 9 is a circuit diagram of an embodiment of the present invention.

Using the above-mentioned round-rod type terminal models or the TS2.3 type terminals, the presence and the non-presence of the generation of an arc discharge are confirmed with a circuit shown in FIG. 9. That is, the male terminal 10 and the female terminal 20 are brought into contact with each other (fitting engagement), these terminals are connected to a battery 100, a variable resistance 101 is inserted between the battery 100 and both terminals, and an electric current quantity which flows in the circuit is made controllable. The electric current quantity which flows in the circuit can be measured by inserting a shunt resistance (standard: 50 mV/50 A) between the battery 100 and both terminals 10, 20 and by mounting an oscilloscope 102 in parallel with the shunt resistance. Further, the voltage between terminals can be measured by setting an oscilloscope 103 in parallel with both terminals 10, 20.

EXAMPLE 1

Then, by changing over an electric current value by changing over a resistance value of the above-mentioned variable resistance while using batteries of 12V, 24V and 36V as the battery 100, the TS2.3 type terminal (or the round-rod type terminal model) is separated at a separation speed (100 mm/min), and the presence or the non-presence of the generation of an arc discharge is determined based on waveforms on the above-mentioned oscilloscopes 102, 103 and with naked eyes. Further, by integrating a product of voltage and current with time, the arc generated energy which is generated by the arc discharge is obtained. Here, when the oscilloscope waveforms become square waveforms, the time is below a measurable lower limit and hence, even when a slight flash is observed, the energy is treated as 0J. Further, the slight flash does not substantially damage the terminal and hence, it is classified into the non-presence of arc discharge.

Figure 10:
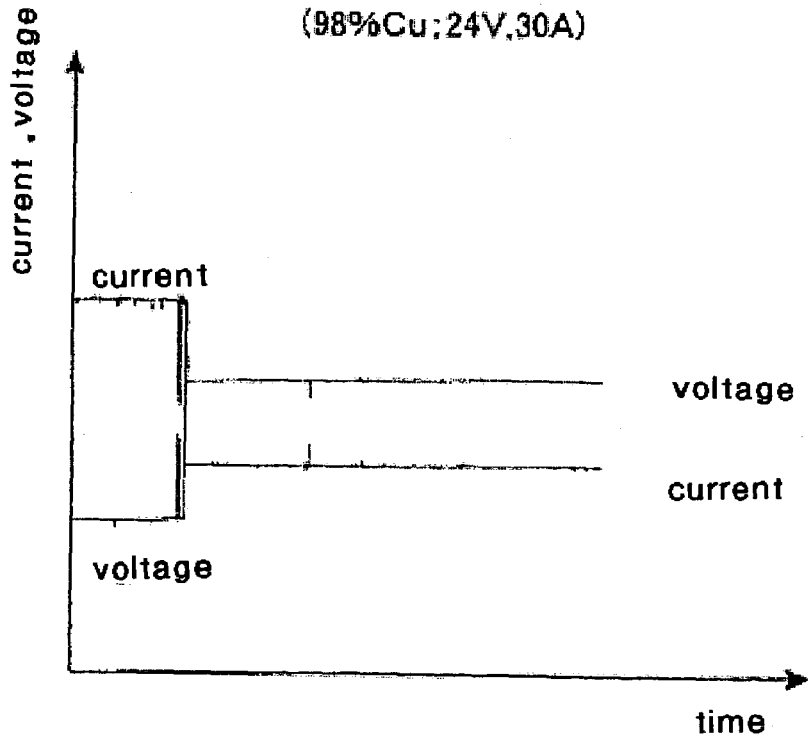
FIG. 10 shows oscilloscope waveforms indicating a result of an experimental example.
Figure 11:
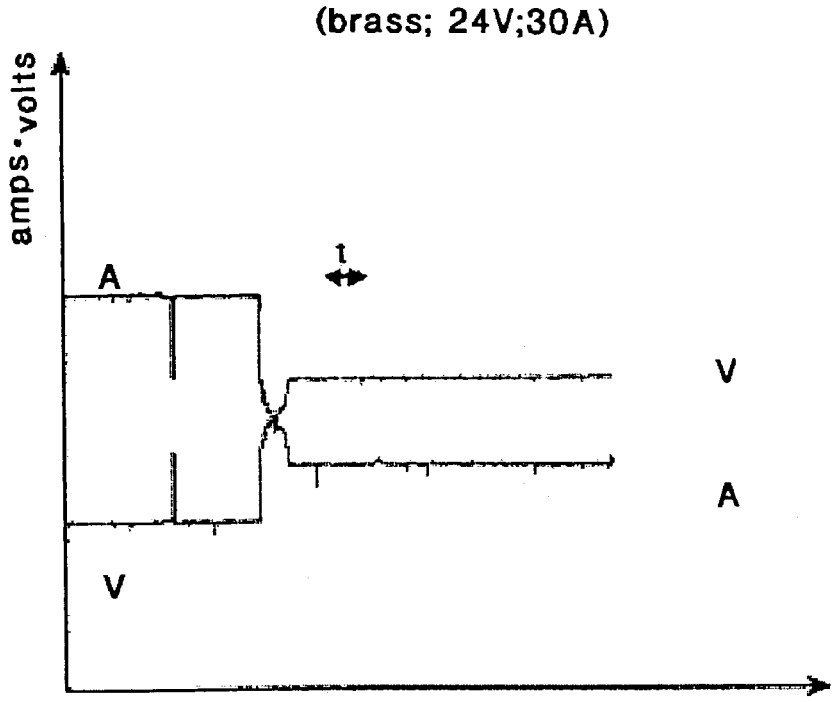
FIG. 11 shows oscilloscope waveforms indicating another result of an experimental example.

A result of the experimental example is shown in Table 4. Further, as typical oscilloscope waveforms, an example (FIG. 10) in which the material 13 is separated under conditions of voltage between terminals of 24 V and the current between terminals of 30 A and an example (FIG. 11) in which the material 24 (brass) is separated under conditions of the voltage between terminals of 24 V and the current between terminals of 30 A are exemplified. In the example shown in FIG. 10, since the arc discharge is not generated (that is, time=0), the arc energy is also 0 J. In the example shown in FIG. 11, by integrating the product of voltage and current with the arc discharge generation time t, the arc energy amounts to 32J.

TABLE 4A

| voltage between terminals (V) | current between terminals (A) | presence or non-presence of arc discharge (energy) | | | | | | | |
|---|---|---|---|---|---|---|---|---|---|
| | | material 10 Zn | material 24 brass | material 13 approximately 98% Cu | material 14 approximately 98% Cu | material 15 approximately 98% Cu | material 1 pure Cu | material 3 pure tin | material 2 pure Ni |
| 12 | 43 | — | not present (0J) | — | — | — | — | — | — |
| 24 | 10 | — | not present (0J) | — | — | — | — | — | — |
| 24 | 20 | — | present (16J) | — | — | — | — | — | — |
| 24 | 30 | — | present (32J) | — | — | — | — | — | — |
| 24 | 43 | — | present (67J) | — | — | — | — | — | — |
| 36 | 5 | — | not present (0J) | not present (0J) | not present (0J) | not present (0J) | not present (0J) | not present (0J)* | not present (0J)* |
| 36 | 7 | — | present (33J) | not present (0J) | not present (0J) | not present (0J) | not present (0J) | not present (0J)* | not present (0J)* |
| 36 | 10 | present (69J)* | present (34J)* present (52J) | not present (0J) | not present (0J) | not present (0J) | not present (0J)* not present (0J) | not present (0J)* | not present (0J)* |
| 36 | 20 | — | present (66J) | not present (0J) | not present (0J) | not present (0J) | not present (0J) | not present (0J)* | not present (0J)* |
| 36 | 30 | — | present◆ | not present (0J) | not present (0J) | not present (0J) | not present (0J) | not present (0J)* | not present (0J)* |
| 36 | 50 | — | present◆ | present (96J) | present (87J) | present (104J) | present (81J) | present (89J) | present (88J) |

Note: The asterisk "*" indicates examples which use a round rod. Absence of the asterisk indicates examples which use TS2, 3 type terminals.
Although an experiment is not particularly carried out with respect to portions indicated by mark ◆, one skilled in the art will appreciate that an arc is generated based on a result at a low-current side.

As can be clearly understood from Table 4A, when the voltage between terminals is less than approximately 20 V (approximately 12 V), irrespective of the kind of the terminal materials, the arc discharge is not recognized. Then, when the voltage between terminals exceeds approximately 20 V (particularly when the voltage between terminals is not less than 36V), it is understood that even under the condition that the arc discharge is generated when brass (material 24) is used, when the metal-based materials 1 to 3, 13 to 15 are used, the arc discharge can be suppressed. The result of the voltage between terminals of 36 V and the current between terminals of 10 A in Table 4A indicates that the larger a content of Cu, Sn, Ni or the like (the smaller a content of Zn), the arc discharge can be suppressed. It is considered that the reason that the terminal of the present invention exhibits excellent arc resistance lies in that a content of Cu, Sn, Ni or the like is high.

Figure 15:
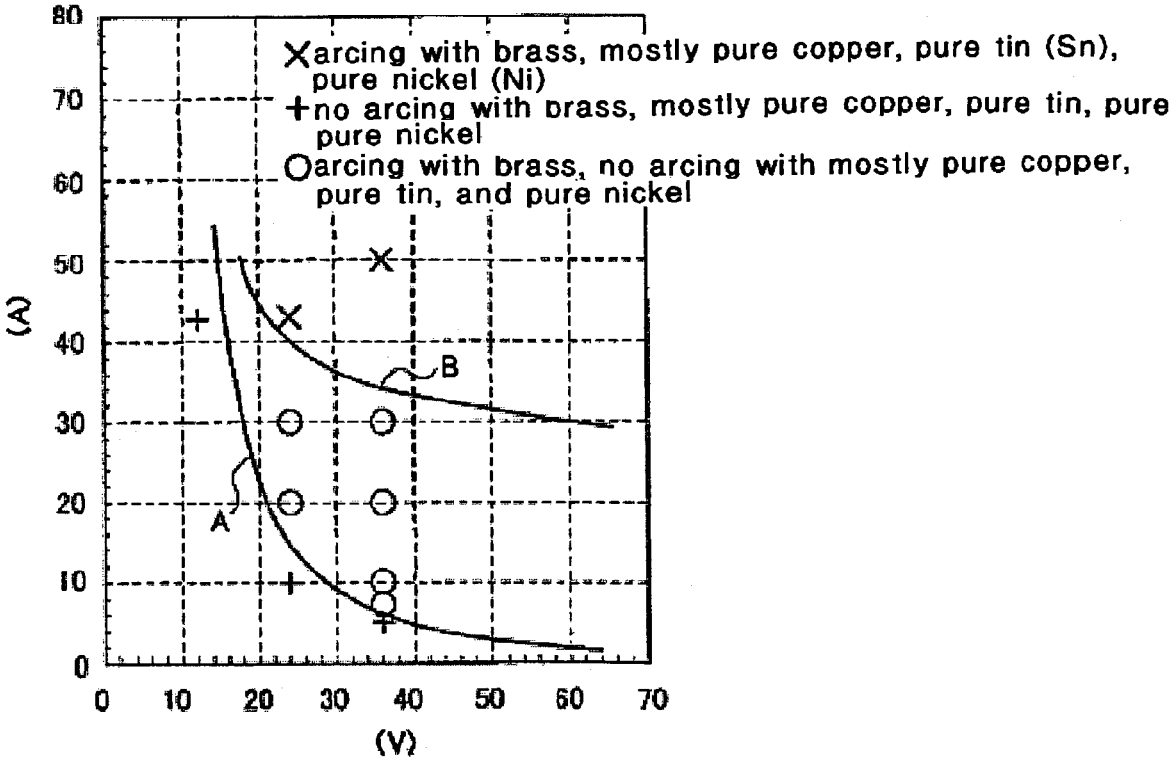
FIG. 15 is a graph showing a result of an experimental example 1.

A result of the experimental example is shown in Table 4B and FIG. 15. In FIG. 15, 98% Cu (materials 13 . 15 and 26) and pure copper (material 1) are referred to as substantially pure Cu as a general term (the same goes for the description hereinafter). Further, as typical oscilloscope waveforms, an example (FIG. 10) in which the material 13 is separated under conditions of voltage between terminals of 24 V and the current between terminals of 30 A and an example (FIG. 11) in which the material 24 (brass) is separated under conditions of the voltage between terminals of 24 V and the current between terminals of 30 A are exemplified. In the example shown in FIG. 10, since the arc discharge is not generated (that is, time=0), the arc energy is also 0J. In the example shown in FIG. 11, by integrating the product of voltage and current with the arc discharge generation time t, the arc energy amounts to 32J.

TABLE 4B

| voltage between terminals (V) | current between terminals (A) | presence or absence of arc discharge (energy) | | | | | | | | |
|---|---|---|---|---|---|---|---|---|---|---|
| | | material 10 Zn | material 2 brass | material 13 first 98% Cu | material 14 second 98% Cu | material 15 third 98% cu | material 26 fourth 98% Cu | material 1 pure Cu | material 3 pure tin | material 2 pure Ni |
| 12 | 43 | — | not present (0J) | not present (0J) | — | — | — | — | — | — |

TABLE 4B-continued

| voltage between terminals (V) | current between terminals (A) | presence or absence of arc discharge (energy) material 10 Zn | material 2 brass | material 13 first 98% Cu | material 14 second 98% Cu | material 15 third 98% cu | material 26 fourth 98% Cu | material 1 pure Cu | material 3 pure tin | material 2 pure Ni |
|---|---|---|---|---|---|---|---|---|---|---|
| 24 | 10 | — | not present (0J) | not present (0J) | — | — | — | — | — | — |
| 24 | 20 | — | present (16J) | not present (0J) | — | — | — | — | — | — |
| 24 | 30 | — | present (32J) | not present (0J) | — | — | — | — | — | — |
| 24 | 43 | — | present (67J) | present (17J) | — | — | — | — | — | — |
| 36 | 5 | — | not present (0J) | not present (0J) | not present (0J) | not present (0J) | not present (0J) | not present (0J) | not present (0J)* | not present (0J)* |
| 36 | 7 | — | present (33J) | not present (0J) | not present (0J) | not present (0J) | not present (0J) | not present (0J) | not present (0J)* | not present (0J)* |
| 36 | 10 | present (69J)* | present (34J)* present (52J) | not present (0J)* | not present (0J) | not present (0J) | not present (0J) | not present (0J)* not present (0J) | not present (0J)* | not present (0J)* |
| 36 | 20 | — | present (66J) | not present (0J) | not present (0J) | not present (0J) | not present (0J) | not present (0J) | not present (0J)* | not present (0J)* |
| 36 | 30 | — | present◆ | — | not present (0J) | not present (0J) | not present (0J) | not present (0J) | not present (0J)* | not present (0J)* |
| 36 | 50 | — | present◆ | — | present (96J) | present (87J) | present (104J) | present (81J) | present (89J) | present (88J) |

Note: Asterisk "*" indicates examples which use a round rod. No asterisk indicates examples which use TS2, 3 type terminals.
Although an experiment is not particularly carried out with respect to portions indicated by mark ◆, one skilled in the art will appreciate that an arc is generated based on a result at a low-current side.

As can be clearly understood from Table 4B, when the voltage between terminals is less than approximately 20 V (approximately 12 V), irrespective of the kind of the terminal materials, the arc discharge is not recognized. Then, when the voltage between terminals exceeds approximately 20V (particularly when the voltage between terminals is not less than 36V), as can be clearly understood from FIG. 15, when the substantially pure Cu, Sn, pure Ni or the like is used as the material of the electrical contact portion, the arc discharge can be suppressed even under the condition in which the arc discharge is generated when brass is used as the material of the electrical contact portion. The result of the voltage between terminals of 36V and, 10 A in Table 4B indicates that the larger a content of Cu, Sn, Ni or the like (the smaller a content of Zn, P or the like), the arc discharge is suppressed. The reason that the terminal of the present invention exhibits excellent arc resistance is that a content of Cu, Sn, Ni or the like is high.

EXAMPLE 2

The experiment is performed under the same conditions as the experimental Example 1 except for that the separation speed of the terminal (or terminal model) is sufficiently made slower (50 mm/min) than the separation speed in the experimental Example 1.

A result is shown in Table 5.

TABLE 5

| voltage between terminals (V) | current between terminals (A) | presence or non-presence of arc discharge (energy) material 24 brass | material 13 approximately 98% Cu |
|---|---|---|---|
| 24 | 5 | not present (0J) | not present (0J) |
| 24 | 10 | present (30J) | not present (0J) |

TABLE 5-continued

| voltage between terminals (V) | current between terminals (A) | presence or non-presence of arc discharge (energy) material 24 brass | material 13 approximately 98% Cu |
|---|---|---|---|
| 24 | 20 | present (45J) | not present (0J) |
| 24 | 30 | present* | not present (0J) |
| 36 | 2 | not present (0J) | not present (0J) |
| 36 | 5 | not present (0J) | not present (0J) |
| 36 | 10 | present (73J) | not present (0J) |
| 36 | 20 | present* | not present (0J) |
| 36 | 30 | present* | not present (0J) |

*Although an experiment is not carried out, one skilled in the art will appreciate that an arc is generated based on a result at a low current side.

The experiment is performed under the same conditions as the experimental Example 1 except for that the separation speed of the terminal (or terminal model) is sufficiently made faster (500 mm/min) than the separation speed in the experimental Example 1.

Figure 16:
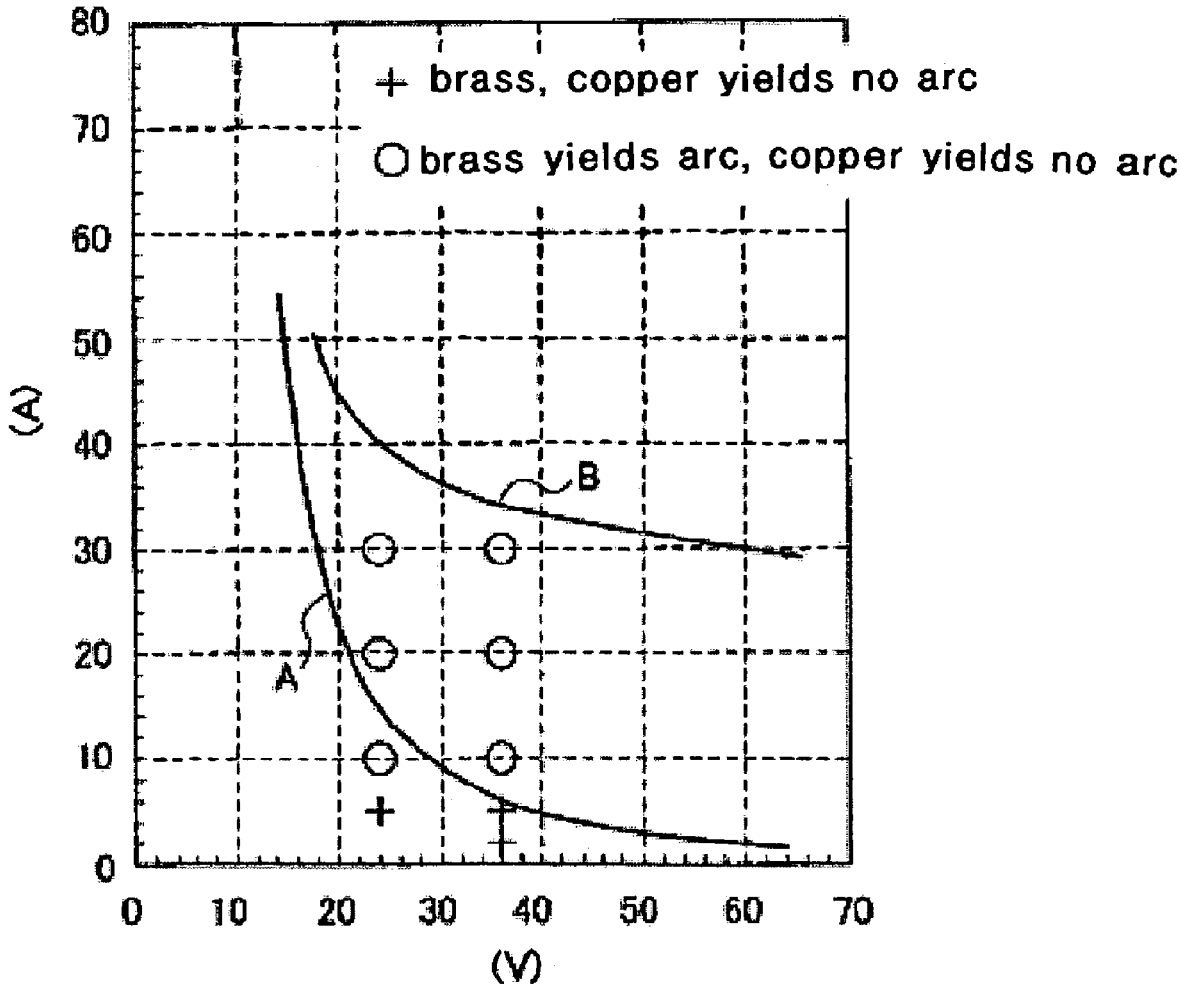
FIG. 16 is a graph showing a result of an experimental example 2.
Figure 17:
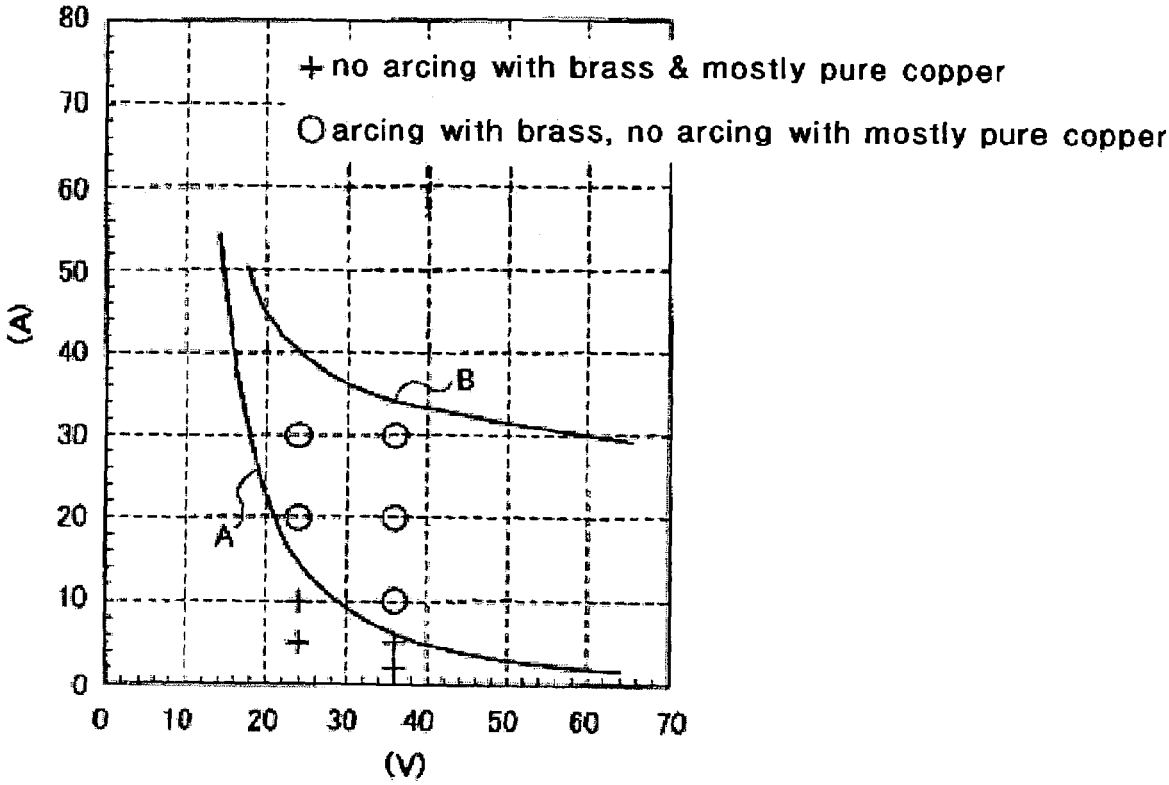
FIG. 17 is a graph showing a result of an experimental example 3.

A result is shown in Table 6 and in FIG. 16.

TABLE 6

| voltage between terminals (V) | current between terminals (A) | presence or non-presence of arc discharge (energy) material 24 brass | material 13 approximately 98% Cu |
|---|---|---|---|
| 24 | 5 | not present (0J) | not present (0J) |
| 24 | 10 | not present (0J) | not present (0J) |
| 24 | 20 | present (32J) | not present (0J) |
| 24 | 30 | present* | not present (0J) |
| 36 | 2 | not present (0J) | not present (0J) |
| 36 | 5 | not present (0J) | not present (0J) |

TABLE 6-continued

| voltage between terminals (V) | current between terminals (A) | presence or non-presence of arc discharge (energy) material 24 brass | material 13 approximately 98% Cu |
|---|---|---|---|
| 36 | 10 | present (28J) | not present (0J) |
| 36 | 20 | present* | not present (0J) |
| 36 | 30 | present* | not present (0J) |

*Although an experiment is not carried out, it is understood to those skilled in the art an arc is generated based on a result at a low current side.

As can be clearly understood from Tables 5 and 6, with the use of the material 13 within a range in which the voltage between terminals assumes 36V to 60V and the current between terminals assumes 6 A to 30 A, irrespective of the case in which the separation speed of the terminal is fast (500 mm/min) and the case in which the separation speed of the terminal is slow (50 mm/min), it is possible to suppress the arc discharge. Here, as can be clearly understood from Table 5, when the separation speed is slow, although there exists a region (24V, 10 A) where the approximately 98% copper is better than brass with respect to the arc resistance at a lower voltage/lower current side, the range to which the present invention is applicable is set to the high voltage (36V to 60V)/high current side (6 A to 30 A) to suppress the arc discharge without being restricted by the separation speed.

EXAMPLE 4

The experiment on the arc resistance is performed under the same conditions as the experimental Example 1 except for that the battery 100 of 36V is used. As the base materials of the terminal or the terminal model, the metal-based materials 1 to 25 are used. The arc-resistance is checked based on whether an arc discharge is generated or not when the terminals are separated from each other. A result is shown in Tables 7A and 7B. Here, the experiment on the materials 13 to 16 is performed using the TS2.3 type terminal.

Evaluation Criterion:

Good: An arc discharge is not generated.

x: An arc discharge is generated.

TABLE 7A

| base material of terminal | current between terminals (voltage between terminals: 36V) 10A | 20A | 30A | remarks main component, minute |
|---|---|---|---|---|
| material 1 | good | good | good | Cu |
| material 2 | good | good | good | Ni |
| material 3 | good | good | good | Sn |
| material 4 | good | good | x (48J) | Fe |
| material 5 | good | good | x (51J) | W |
| material 6 | — | good | x (183J) | Ag |
| material 7 | good | good | x | Al |
| material 8 | good | good | x (321J) | Mo |
| material 9 | — | good | x (13J) | Au |
| material 10 | x | x | x | Zn |
| material 11 | x (37J) | x (90J) | x (46J) | Mg |
| material 12 | x (6J) | x (6J) | x (14J) | Pb |
| material 13 | good | good | good | approximately 98% Cu |
| material 14 | good | good | good | approximately 98% Cu |
| material 15 | good | good | good | approximately 98% Cu |
| material 16 | good | good | good | approximately 94% Cu |
| material 17 | good | good | good | approximately 95% Ni |
| material 18 | — | good | good | approximately 99% Cu |
| material 19 | good | good | good | approximately 70% Fe |
| material 20 | — | good | good | Cu/Be |
| material 21 | — | good | good | P:0.06% |
| material 22 | — | good | x | P:0.08% |
| material 23 | good | good | x | approximately 76% Ni |
| material 24 | x | x | x | approximately 65% Cu |
| material 25 | x | x | x | approximately 96% |

TABLE 7B

| base material of terminal | current between terminals (voltage between terminals 36V) 10A | 20A | 30A | remarks main component | component at less than Bp2000 degree centigrade |
|---|---|---|---|---|---|
| material 1 | good | good | good | Cu | — |
| material 2 | good | good | good | Ni | — |
| material 3 | good | good | good | Sn | — |
| material 4 | good | good | x (48J) | Fe | — |
| material 5 | good | good | x (51J) | W | — |
| material 6 | — | good | x (183J) | Ag | — |
| material 7 | good | good | x | Al | — |
| material 8 | good | good | x (321J) | Mo | — |
| material 9 | — | good | x (13J) | Au | — |
| material 10 | x | x | x | Zn | 100 |
| material 11 | x (37J) | x (90J) | x (46J) | Mg | 100 |
| material 12 | x (6J) | x (6J) | x (14J) | Pb | 100 |
| material 13 | good | good | good | approximately 98% Cu | not more than 0.40% |
| material 14 | good | good | good | approximately 98% Cu | not more than 0.04% |
| material 15 | good | good | good | approximately 98% Cu | 0.05% |
| material 26 | good | good | good | approximately 98% Cu | 0.15% |
| material 16 | good | good | good | approximately 94% Cu | not more than 0.4% |
| material 17 | good | good | good | approximately 95% Ni | not more than 0.03% |
| material 18 | — | good | good | approximately 99% Cu | 0% |
| material 19 | good | good | good | approximately 70% Fe | not more than 0.045% |
| material 23 | good | good | x | approximately 76% Ni | 0.01% |
| material 24 | x | x | x | approximately 65% Cu | 35% |
| material 25 | x | x | x | approximately 96% | approximately 2% |

From Tables 7A and 7B, it is understood that when the base material is made of metal in a single form such as Cu, Ni and Sn, and the voltage between terminals is set to 36V and the current between terminals is set to 10 A to 30 A, the arc discharge is not generated and the base materials of the terminal exhibit excellent arc resistance. Further, all of Mg, Pb, Zn which are components having a boiling point of less than 2000 degrees centigrade generate an arc discharge when the current between terminals is 10 A and hence, these metals exhibit inferior arc resistance. Since Fe, W, Ag, Al, Mo, Au and the like do not generate an arc discharge until the current between terminals assumes 20 A and hence, it is reasonable to say that they belong to a group of metals which exhibit relatively excellent arc resistance.

All of the materials 13–21 and 26 are examples of metal-based materials (of which materials 13–18 and 26 contain 80 mass % of Cu or Ni and of which a component having a boiling point of less than 2000 degrees centigrade is not more than 1.5 mass %) which exhibit extremely excellent arc-discharge resistance. From such a result, it is understood that the arc-resistant terminals of the present invention exhibit excellent arc-discharge resistance. Particularly, since the materials 13–16 and 26 contain Sn, it is possible to obtain the terminals which are also excellent in strength. The material 19 is an example which uses so-called SUS304 and it is understood to those skilled in the art that the example exhibits excellent arc resistance.

Further, the material 21 is an example which contains 0.06 mass % of phosphorous and exhibits the favorable arc resistance at the current between terminals of 30 A. However, the material 22 which contains 0.08 mass % of phosphorous lowers the arc resistance thereof at the current between terminals of 30 A. In view of the result, it is understood that a content of phosphorus in the metal-based material is less than 0.08 mass %, and preferably not more than 0.06 mass %.

The reason that the arc resistance of the material 23 is lowered when the current between terminals is 30 A is considered that a content of Fe which constitutes the component belonging to the second group is high (7.7 mass %). Brass (material 24) which has been generally used as the material for a connector terminal generates an arc discharge when the current between terminals falls within a range of 10 A to 30 A in the high-voltage application of 36V and hence, it is understood that brass cannot be used in such an application. Further, the material 25 is an example in which a total quantity of Zn and P, which constitutes components having a boiling point of less than 2000 degrees centigrade, and which gives an adverse influence to the arc resistance is approximately 2 mass %. Since an arc discharge is generated when the current between terminals falls within a range of 10 A to 30 A, it is understood that it is preferable to set a quantity of the components, which has a boiling point of less than 2000 degrees centigrade, to a value not more than a fixed quantity.

EXAMPLE 5

The influence which the shape of the terminal gives to the generation of an arc discharge is studied using round-rod type terminal models and TS2.3 type terminals. As the metal-based materials, the material 14 and the material 24 are used. A result of the experimental example is shown in Table 8 and Table 9.

TABLE 8

| | current between terminals | | |
|---|---|---|---|
| material 14 | 20A | 30A | 40A |
| TS2.3 type terminal | not present (0J) | not present (0J) | present (53J) |
| round-rod type terminal | not present (0J) | not present (0J) | present (151J) |

voltage between terminals: 36V
terminal separation speed: 100 mm/min

As can be clearly understood from Table 8, in both cases of the TS2.3 type terminal and the round-rod type terminal, an arc discharge is not generated until the current between terminals reaches 30 A and the arc discharge is generated when the current between terminals reaches 40 A. From these results, it is understood that according to the present invention, irrespective of the shape of the terminal, that is, the shape of the TS2.3 type terminal or the shape of the round-rod type terminal, the arc discharge can be suppressed so long as the current between terminal falls within a range of 30 A.

TABLE 9

| | current between terminals | | |
|---|---|---|---|
| material 24 | 5A | 7A | 10A |
| TS2.3 type terminal | not present (0J) | present (33J) | present (52J) |
| round-rod type terminal | not present (0J) | present (19J) | present (34J) |

voltage between terminals: 36V
terminal separation speed: 100 mm/min

The material 24 is a case in which brass which is liable to easily generate an arc discharge is used. The arc discharge is not generated until the current between terminals reaches 5 A, while the arc discharge is generated when the current between terminals falls in a range of 7 A to 10 A. Also from these results, it is confirmed that the influence that the shape of terminal such as the shape of the round-rod type terminal or the shape of the TS2.3 type terminal gives to the generation of arc discharge is small.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present application claims priority under 35 U.S.C. § 119 of Japanese Patent Application Nos. JP2002-112588, filed on Apr. 15, 2002; JP2002-204761, filed on Jul. 12, 2002; JP2002-208903, filed on Jul. 17, 2002; JP2002-242719, filed on Jul. 19, 2002; JP2002-241116, filed on Aug. 21, 2002; JP2002-290414, filed on Oct. 2, 2002; and JP2002-321414, filed on Nov. 25, 2002, all the disclosures of which are expressly incorporated by reference herein in their entireties.

What is claimed is:

1. An arc-resistant terminal comprising:

a metal-based electrical contact portion comprising at least one of Cu, Ni or Sn, and not more than 0.06 mass % P; said electrical contact portion is plated with at least one of Sn, Ni, Au or Ag; and the thickness of the plating at a distal end of the contact portion and the vicinity thereof is less than a thickness of plating on a main part of the contact portion or is absent, wherein the arc-resistant terminal is capable of suppressing arc discharge upon terminal separation under conditions wherein a voltage between the arc-resistant terminal and a second terminal immediately after separation thereof is DC36V to 60V and a current between terminals during contact is 6 A to 30 A.

2. The arc-resistant terminal of claim 1 capable of suppressing arc discharge wherein the terminal separation speed is between about 30 to 600 mm/mm.

3. A couple or connector comprising an arc-resistant terminal according to claim 1, wherein the electrical contact portion consists essentially of Cu and inevitable impurities.

4. The arc-resistant terminal of claim 1, the electrical contact portion comprising Cu and a positive amount not more than 6 mass % Sn.

5. The arc-resistant terminal of claim 1, the electrical contact portion consisting essentially of Cu, a positive amount not more than 6 mass % Sn, and inevitable impurities.

6. The arc-resistant terminal of claim 1, the electrical contact portion comprising Cu, not more than 0.05 mass % P, a positive amount not more than 0.9 mass % Sn, and a positive amount not more than 1 mass % Ni.

7. The arc-resistant terminal of claim 1, the electrical contact portion consisting essentially of Cu, not more than 0.05 mass % P, a positive amount not more than 0.9 mass % Sn, a positive amount not more than 1 mass % Ni, and inevitable impurities.

8. An electrical couple or connector member comprising the arc-resistant terminal of claim 1.

9. A circuit comprising an electrical couple or connector comprising the arc-resistant terminal of claim 1 and a second terminal, wherein the voltage between the arc-resistant terminal and the second terminal immediately after separation thereof is DC36V to 60V and a current between terminals during contact is 6 A to 30 A.

10. The arc-resistant terminal of claim 1, the electrical contact portion consisting essentially of:

at least one of Cu, Ni or Sn, not more than 0.06 mass % P, and inevitable impurities.

11. The arc-resistant terminal of claim 10, the electrical contact comprising two of Cu, Ni, or Sn.

12. An electrical couple or connector member comprising the arc-resistant terminal of claim 10.

13. A circuit comprising an electrical couple or connector comprising the arc-resistant terminal of claim 10 and a second terminal, wherein the voltage between the arc-resistant terminal and the second terminal immediately after separation thereof is DC36V to 60V and a current between terminals during contact is 6 A to 30 A.

14. The arc-resistant terminal of claim 1, comprising:

not more than 0.045 mass % P, not more than 0.08 mass % C, not more than 1 mass % Si, not more than 2 mass % Mn, not more than 0.03 mass % S, 8 to 10.5 mass % Ni, 18 to 20 mass % Cr, Fe, and inevitable impurities.

15. An electrical couple or connector member comprising the arc-resistant terminal of claim 14.

16. A circuit comprising an electrical couple or connector comprising the arc-resistant terminal of claim 14 and a second terminal, wherein the voltage between the arc-resistant terminal and the second terminal immediately after separation thereof is DC36V to 60V and a current between terminals during contact is 6 A to 30 A.

17. The arc-resistant terminal of claim 1, wherein the electrical contact portion consists essentially of:

not more than 0.4 mass % of Zn and P combined, not more than 10 mass % of Fe, Ag and Al combined, and at least one of Cu, Sn or Ni, and inevitable impurities, wherein the arc-resistant terminal is capable of suppressing arc discharge upon terminal separation under conditions wherein a voltage between the arc-resistant terminal and a second terminal immediately after separation thereof is DC36V and a current between terminals during contact is 7 A to 30 A.

18. An electrical couple or connector member comprising the arc-resistant terminal of claim 17.

19. A circuit comprising an electrical couple or connector comprising the arc-resistant terminal of claim 17 and a second terminal, wherein the voltage between the arc-resistant terminal and the second terminal immediately after separation thereof is DC36V and a current between terminals during contact is 7 A to 30 A.

20. The arc-resistant terminal of claim 1, wherein the electrical contact portion consists essentially of:

not more than 0.15 mass % of Zn and P combined, not more than 10 mass % of Fe, Ag and Al combined, and at least one of Cu, Sn or Ni, and inevitable impurities, wherein the arc-resistant terminal is capable of suppressing arc discharge upon terminal separation under conditions wherein a voltage between the arc-resistant terminal and a second terminal immediately after separation thereof is DC36V and a current between terminals during contact is 7 A to 30 A.

21. An electrical couple or connector member comprising the arc-resistant terminal of claim 20.

22. A circuit comprising an electrical couple or connector comprising the arc-resistant terminal of claim 20 and a second terminal, wherein the voltage between the arc-resistant terminal and the second terminal immediately after separation thereof is DC36V and a current between terminals during contact is 7 A to 30 A.

23. The arc-resistant terminal of claim 1, wherein the electrical contact portion consists essentially of:

not more than 0.4 mass % of Zn and P combined, not more than 10 mass % of Fe, Ag and Al combined, one of Cu, Sn or Ni, and inevitable impurities, wherein the arc-resistant terminal is capable of suppressing arc discharge upon terminal separation under conditions wherein a voltage between the arc-resistant terminal and a second terminal immediately after separation thereof is DC36V and a current between terminals during contact is 7 A to 30 A.

24. An electrical couple or connector member comprising the arc-resistant terminal of claim 23.

25. A circuit comprising an electrical couple or connector comprising the arc-resistant terminal of claim 23 and a second terminal, wherein the voltage between the arc-resistant terminal and the second terminal immediately after separation thereof is DC36V and a current between terminals during contact is 7 A to 30 A.

26. The arc-resistant terminal of claim 1, wherein the electrical contact portion consists essentially of:

not more than 0.15 mass % of Zn and P combined, not more than 0.2 mass % of Fe, at least one of Cu, Sn or Ni, and inevitable impurities, wherein the arc-resistant terminal is capable of suppressing arc discharge upon terminal separation under conditions wherein a voltage between the arc-resistant terminal and a second terminal immediately after separation thereof is DC36V and a current between terminals during contact is 7 A to 30 A.

27. An electrical couple or connector member comprising the arc-resistant terminal of claim 26.

28. A circuit comprising an electrical couple or connector comprising the arc-resistant terminal of claim 26 and a second terminal, wherein the voltage between the arc-resistant terminal and the second terminal immediately after separation thereof is DC36V and a current between terminals during contact is 7 A to 30 A.

29. The arc-resistant terminal of claim 1, wherein the electrical contact portion consists essentially of:

not more than 0.4 mass % of Zn and P combined, not more than 0.2 mass % of Fe, one of Cu, Sn or Ni, and inevitable impurities, wherein the arc-resistant terminal is capable of suppressing arc discharge upon terminal separation under conditions wherein a voltage between the arc-resistant terminal and a second terminal immediately after separation thereof is DC36V and a current between terminals during contact is 7 A to 30 A.

30. An electrical couple or connector member comprising the arc-resistant terminal of claim 29.

31. A circuit comprising an electrical couple or connector comprising the arc-resistant terminal of claim 29 and a second terminal, wherein the voltage between the arc-resistant terminal and the second terminal immediately after separation thereof is DC36V and a current between terminals during contact is 7 A to 30 A.

32. The arc-resistant terminal of claim 1, wherein:

the electrical contact portion consists essentially of:

not more than 0.15 mass % of Zn and P combined, not more than 0.2 mass % of Fe, one of Cu, Sn or Ni, and inevitable impurities, wherein the arc-resistant terminal is capable of suppressing arc discharge upon terminal separation under conditions wherein a voltage between the arc-resistant terminal and a second terminal immediately after separation thereof is DC36V and a current between terminals during contact is 7 A to 30 A.

33. The arc-resistant terminal of claim 1, wherein the electrical contact portion consists essentially of:

Sn: 1.8 to 2.2 mass %,

Fe: 0.05 to 0.12 mass %,

P: 0.025 to 0.40 mass %,

Cu, and inevitable impurities, wherein the arc-resistant terminal is capable of suppressing arc discharge upon terminal separation under conditions wherein a voltage between the arc-resistant terminal and a second terminal immediately after separation thereof is DC36V and a current between terminals during contact is 7 A to 30 A.

34. An electrical couple or connector member comprising the arc-resistant terminal of claim 33.

35. A circuit comprising an electrical couple or connector comprising the arc-resistant terminal of claim 33 and a second terminal, wherein the voltage between the arc-resistant terminal and the second terminal immediately after separation thereof is DC36V and a current between terminals during contact is 7 A to 30 A.

36. An arc-resistant terminal comprising:

a metal-based electrical contact portion consisting essentially of at least one of Cu, Ni or Sn, 0 mass % P, and inevitable impurities; and plating on said electrical contact portion, the plating comprising at least one of Sn, Ni, Au or Ag; and the thickness of the plating at a distal end of the contact portion and the vicinity thereof is less than a thickness of plating on a main part of the contact portion or is absent, wherein the arc-resistant terminal is capable of suppressing arc discharge upon terminal separation under conditions wherein a voltage between the arc-resistant terminal and a second terminal immediately after separation thereof is DC36V to 60V and a current between terminals during contact is 6 A to 30 A.

37. An arc-resistant terminal comprising:

a metal-based electrical contact portion consisting essentially of at least one of Cu, Ni or Sn, and not more than 0.06 mass % P, and inevitable impurities, plating on the electrical contact portion, the plating comprising at least one of Sn, Ni, Au or Ag, the thickness of the plating at a distal end of the contact portion and the vicinity thereof is less than a thickness of plating on a main part of the contact portion or is absent, wherein the arc-resistant terminal is capable of suppressing arc discharge upon terminal separation under conditions wherein a voltage between the arc-resistant terminal and a second terminal immediately after separation thereof is DC36V to 60V and a current between terminals during contact is 6 A to 30 A.

38. The arc-resistant terminal of claim 37, the electrical contact comprising not more than 0.04 mass % P.

39. An arc-resistant terminal comprising:

a metal-based electrical contact portion consisting essentially of not more than 0.06 mass % P, a positive content of Be of not more than 2 mass %, Cu, and inevitable impurities; and plating on the electrical contact portion, the plating comprising at least one of Sn, Ni, Au or Ag; and the thickness of the plating at a distal end of the contact portion and the vicinity thereof is less than a thickness of plating on a main part of the contact portion or is absent, wherein the arc-resistant terminal is capable of suppressing arc discharge upon terminal separation under conditions wherein a voltage between the arc-resistant terminal and a second terminal immediately after separation thereof is DC36V to 60V and a current between terminals during contact is 6 A to 30 A.

40. An electrical couple or connector member comprising the arc-resistant terminal of claim 39.

41. A circuit comprising an electrical couple or connector comprising the arc-resistant terminal of claim 39 and a second terminal, wherein the voltage between the arc-resistant terminal and the second terminal immediately after separation thereof is DC36V to 60V and a current between terminals during contact is 6 A to 30 A.

42. An arc-resistant terminal comprising:

a metal-based electrical contact portion comprising at least one of Cu, Ni or Sn, not more than 0.06 mass % P, and a positive amount not more than 0.6 mass % of at least one of Fe, W, Ag, Al, Mo or Au; and plating on the electrical contact portion, the plating comprising at least one of Sn, Ni, Au or Ag, and the thickness of the plating at a distal end of the contact portion and the vicinity thereof is less than a thickness of plating on a main part of the contact portion or is absent, wherein the arc-resistant terminal is capable of suppressing arc discharge upon terminal separation under conditions wherein a voltage between the arc-resistant terminal and a second terminal immediately after separation thereof is DC36V to 60V and a current between terminals during contact is 6 A to 30 A.

43. The arc-resistant terminal of claim 42, wherein the terminal separation speed is between about 30 to 600 mm/mm.

44. The arc-resistant terminal of claim 42, the metal-based electrical contact consisting essentially of: at least one of Cu, Ni or Sn; not more than 0.06 mass % P; a positive amount not more than 0.6 mass % of at least one of Fe, W, Ag, Al, Mo or Au; and inevitable impurities.

45. The arc-resistant terminal of claim 44, the electrical contact comprising not more than 0.04 mass % P.

46. The arc-resistant terminal of claim 44, the electrical contact comprising 0 mass % P.

47. The arc-resistant terminal of claim 44, the electrical contact comprising not more than 0.4 mass % of Fe, W, Ag, Al, Mo or Au.

48. The arc-resistant terminal of claim 44, the electrical contact comprising not more than 0.2 mass % of Fe, W, Ag, Al, Mo or Au.

49. The arc-resistant terminal of claim 44, the electrical contact comprising two of Cu, Ni, or Sn.

50. The arc-resistant terminal of claim 44, the metal-based electrical contact comprising a positive content of Fe not more than 0.4 mass %.

51. The arc-resistant terminal of claim 44, the metal-based electrical contact consisting essentially of: 0.025 to 0.04 mass % P; 0.05 to 0.15 mass % Fe; 1.8 to 2.2 mass % Sn; Cu; and inevitable impurities.

52. The arc-resistant terminal of claim 44, the metal-based electrical contact consisting essentially of: not more than 0.06 mass % P; a positive content of Ag not more than 0.6 mass %; Cu; and inevitable impurities.

53. An electrical couple or connector member comprising the arc-resistant terminal of claim 44.

54. A circuit comprising an electrical couple or connector comprising the arc-resistant terminal of claim 44 and a second terminal, wherein the voltage between the arc-resistant terminal and the second terminal immediately after separation thereof is DC36V to 60V and a current between terminals during contact is 6 A to 30 A.

55. The arc-resistant terminal of claim 42, comprising:

0.05 mass % P, a positive content of Sn not more than 1.7 mass %, a positive content of Fe not more than 0.15 mass %, a positive content of Zn not more than 0.1 mass %, Cu, and inevitable impurities.

56. An electrical couple or connector member comprising the arc-resistant terminal of claim 55.

57. A circuit comprising an electrical couple or connector comprising the arc-resistant terminal of claim 55 and a second terminal, wherein the voltage between the arc-resistant terminal and the second terminal immediately after separation thereof is DC36V to 60V and a current between terminals during contact is 6 A to 30 A.

58. The arc-resistant terminal of claim 42, comprising:

not more than 0.03 mass % P, a positive content of C not more than 0.05 mass %, a positive content of Si is not more than 1.5 mass %, a positive content of Mn not more than 2.0 mass %, a positive content of S not more than 0.03 mass %, a positive content of Cr not more than 1.5 mass %, a positive content of Fe not more than 0.4 mass %, Ni and inevitable impurities.

59. An electrical couple or connector member comprising the arc-resistant terminal of claim 58.

60. A circuit comprising an electrical couple or connector comprising the arc-resistant terminal of claim 58 and a second terminal, wherein the voltage between the arc-resistant terminal and the second terminal immediately after separation thereof is DC36V to 60V and a current between terminals during contact is 6 A to 30 A.

* * * * *

UNITED STATES PATENT AND TRADEMARK OFFICE

CERTIFICATE OF CORRECTION

PATENT NO. : 7,163,753 B2
APPLICATION NO. : 10/413388
DATED : January 16, 2007
INVENTOR(S) : Ota et al.

It is certified that error appears in the above-identified patent and that said Letters Patent is hereby corrected as shown below:

Column 29, line 12 (claim 43 line 3) of the printed patent, “mm/mm” should be --mm/min--.

Signed and Sealed this

Eighth Day of April, 2008

JON W. DUDAS
*Director of the United States Patent and Trademark Office*